US007465128B2

(12) United States Patent
Bruneau

(10) Patent No.: US 7,465,128 B2
(45) Date of Patent: Dec. 16, 2008

(54) ANCHOR DEVICE WITH AN ELASTIC EXPANSION SLEEVE

(76) Inventor: Marcellin Bruneau, 965, Quevillon street, Rouyn Noranda (Quebec) (CA) J9X 5A9

( * ) Notice: Subject to any disclaimer, the term of this patent is extended or adjusted under 35 U.S.C. 154(b) by 212 days.

(21) Appl. No.: 10/577,246

(22) PCT Filed: Oct. 26, 2004

(86) PCT No.: PCT/CA2004/001878

§ 371 (c)(1),
(2), (4) Date: Apr. 26, 2006

(87) PCT Pub. No.: WO2005/040556

PCT Pub. Date: May 6, 2005

(65) Prior Publication Data

US 2007/0031196 A1 Feb. 8, 2007

Related U.S. Application Data

(60) Provisional application No. 60/514,004, filed on Oct. 27, 2003.

(51) Int. Cl.
*E21D 21/00* (2006.01)

(52) U.S. Cl. ..... 405/259.3; 405/259.1

(58) Field of Classification Search ..... 405/259.1, 405/259.3, 259.4, 259.5, 259.6, 302.1
See application file for complete search history.

(56) References Cited

U.S. PATENT DOCUMENTS 2,525,198 A * 10/1950 Beijl ..... 405/259.3
3,651,651 A 3/1972 Triplett
4,312,604 A 1/1982 Fu et al.

(Continued)

FOREIGN PATENT DOCUMENTS

| | | | |
|---|---|---|---|
| CA | 2180878 | | 1/1998 |
| DE | 3405469 | A1 * | 9/1985 |
| EP | 67941 | A2 * | 12/1982 |
| SU | 1511425 | | 9/1989 |

*Primary Examiner*—Frederick L Lagman
(74) *Attorney, Agent, or Firm*—François Martineau

(57) ABSTRACT

The invention relates to an anchor device, for stabilizing an excavation wall and to be inserted into a hole, bored in an excavation wall. Said anchor device comprises a rigid elongated rod which defines a distal end, to be inserted into the bored hole and a proximal end, opposed to the distal end, a support member, mounted on the rod in the vicinity of the proximal end thereof and provided for resting against an outer surface of the wall of rock and an anchor head, mounted on the rod and to be inserted into the hole, bored in the excavation wall. Said anchor head comprises a flexible expandable member, mounted on the rod, made of plastic and capable of radially expanding and stretching and an activating member, movably mounted on the rod, said activating member being capable of moving relative to the rigid rod and to the expandable member and capable of contacting the same in order to exert a pressure. For anchoring the anchor head into the excavation wall at the bored hole, the activating member and the expandable member are displaced relative to one another, such as to contact each other and to allow the activating member to exert a pressure upon the expandable member, in order to cause the radial expansion of at least one portion thereof, so that said portion of the expandable member makes frictional contact on a part of the inner surface, defining the hole bored in the excavation wall.

15 Claims, 17 Drawing Sheets

U.S. PATENT DOCUMENTS

| | | | |
|---|---|---|---|
| 4,472,088 | A | 9/1984 | Martin |
| 4,474,516 | A | 10/1984 | Schiefer |
| 4,631,889 | A | 12/1986 | Adam et al. |
| 4,696,606 | A | 9/1987 | Herron |
| RE32,645 | E | 4/1988 | Scott |
| 5,688,066 | A | 11/1997 | Loose |
| 6,048,149 | A | 4/2000 | Garcia |
| 6,273,655 | B1 | 8/2001 | McAlpine et al. |
| 6,579,049 | B2 | 6/2003 | Kaibach |
| 6,599,059 | B2 | 7/2003 | Calandra, Jr. et al. |

* cited by examiner

ANCHOR DEVICE WITH AN ELASTIC EXPANSION SLEEVE

CROSS REFERENCE DATA

The present patent application claims priority based upon provisional patent application No. 60/514,004 filed in the United States of America on 27 Oct. 2003, in accordance with-the provisions of the Paris Convention.

FIELD OF THE INVENTION

The present invention relates to a supporting device for excavation walls, and more particularly to an anchoring bolt having an anchoring head comprising an elastic expansion sheath.

BACKGROUND OF THE INVENTION

Rock felling in a mine or any other type of underground excavation is usually performed by blasting up with explosive charges, and is followed by an extraction phase during which the thus felled rocks are removed from the working site. Miners must thereafter purge the excavation walls, i.e. generate the fall of rock blocks that have a tendency to detach therefrom, for example with a scaling bolt. After that, the stability of the thus formed shaft walls (of the tunnel, or of the chamber), must be confirmed by implementing one or more supporting techniques. The support of rocky bed is paramount for the workers' safety and for the effective operations in the mine.

There are various supporting techniques, one of which being use of anchoring bolts, for stabilising the rocky bed. So-called mechanical anchoring bolts, or "rockbolt", are the most commonly used in view of their low cost and ease and quickness of installation. A rockbolt comprises an elongated threaded rod, also called stud bolt, at the distal end of which is mounted an expansion shell of generally cylindroid shape. The expansion shell includes a number of elongated metallic blades (typically 2 or 4) surrounding the stud bolt, all-interconnected to one another by one of their ends, and whose external surface is toothed and thus rough surfaced. As with any other anchoring bolt,this type of anchoring bolt is also provided with a bearing plate mounted at the proximal end of the stud bolt. By having the stud bolt rotate in a given direction in relation to the expansion shell, the blades of the expansion shell with open as if petals of a blooming flower, and the expansion shell widens radially.

Before proceeding with the installation of such an anchoring bolt, an elongated bore is drilled orthogonally to the surface of the rock bed wall to stabilise. The bore diameter should be slightly larger than that of the cylindroid expansion shell, to enable ready engagement of the bolt to the bottom of the bore. Thereafter, a worker must rotate the stud bolt by using for example a rotating shaft pneumatic tool. Since the expansion shell cannot freely rotate in the bore because it frictionally abuts against the internal surface of the bore, the rotation of the stud bolt generates a relative rotation of the stud bolt relative to the expansion shell, which enables the latter to open up and enables its toothed blades to firmly grasp the bore wall. Once the expansion shell is anchored in this way in the bore, a nut located at the proximal end of the stud bolt must be screwed against the plate in order to press the latter against the excavation wall, and in order to load the bolt. When the anchoring bolt is loaded, stabilisation of the rocky bed is enabled by the combination action of the pressure exerted by the plate against the excavation wall, and by the pressure exerted by the expansion shell inside the bore.

Such rock bolts have advantages. In particular, these rock bolts are easily and quickly mounted, they are cheap, and they provide the excavation wall with an active support, i.e. they become operational and loaded immediately after their installation. On the other hand, they do have important drawbacks, such that they do not allow their use in all circumstances. In particular, they boast a mediocre performance when used with broken or soft rocks, and are sensitive to vibrations, i.e. they may lose their load following a ground blow or an adjacent blast. Moreover, these bolts have a very small resistance to shear forces. Indeed, if the shear forces are too high at the interface between the internal surface of the bore and the toothed blades of the shell, the internal surface of the bore may crumble, and the teeth of these blades may then release their grip from the internal surface of the bore. Moreover, once they lose their load, the effectiveness of these bolts shift instantly from 100% to 0%, since the expansion shell has then lost its grip on the internal surface of the bore. This could be dangerous, since unless each bolt is individually tested to check if it is still loaded, a mounted bolt having lost its load may leave the impression to the workers that it is still operational whereas in fact it has become none at all. Other types of anchoring bolts also exist and are frequently used to support underground excavation walls, for example cemented bolts. A cemented bolt consists essentially of a toothed bolt surrounded by cement and carrying a bearing plate at its proximal end. Installation of a cemented bolt normally starts by the drilling of an elongated bore, in the same way as for a mechanical bolt, followed by thick-paste cement injection inside the bore. Once cement has been injected, the elongated toothed bolt is engaged into the bore until the bearing plate comes to abut against the excavation wall. The bolt is then loaded passively by the convergence of the rock bed. During this convergence (where the excavation walls tend to close on themselves due to the large pressures naturally present in the rocky bed and amplified by the underground excavations), the bearing plate of the bolt will transfer the load to the bolt. The friction between the cement/rock and the cement/rod contacts, contribute in stabilising the excavation wall in which the cemented bolt is mounted.

This type of bolt is very resistant in tension, and may be used in all types of rocks, even in solft and very broken rocks, contrarily to mechanical bolts. Moreover, this type of bolt is much more resistant to shearing forces than mechanical bolts, and do not lose all its load if the shearing forces become excessive, contrarily to mechanical bolts. On the other hand, installation of cemented bolts takes a lot of time and is expensive, requires use of a cement pump, and is messy and thus not user-friendly for the workers. Moreover, installation of such bolts in vertical position, for example on the excavation top wall, is labour intensive, since it requires cement injection in a vertical bore.

Other anchoring devices may be used for the support of excavation walls such as resin bolts, or friction bolts of the "Split Set" type consisting of a slitted steel tube being hammered into the bottom of the drilled bore and into the excavation wall, but all have a large number of drawbacks.

SUMMARY OF THE INVENTION

The present invention relates to an anchoring device for stabilising an excavation wall, and to be at least partially engaged into a bore drilled into the excavation wall, said anchoring device comprising:

an elongated support member defining a distal end for engagement into the drilled bore, and a proximal end opposite said distal end;

a bearing member mounted on said support member proximate to said proximal end thereof, for bearing against an exterior surface of the rocky bed; and an anchoring head mounted on said support member and for engagement into the drilled bore of the excavation wall, said anchoring head comprising:

a flexible expansion member mounted on said support member, made from an elastic material and adapted to stretch and radially widen; and an actuation member movably mounted on said support member, said actuation member mounted for relative movement to said support member and to said expansion member and engageable with the latter, said actuation member adapted to exert a pressure on said expansion member; wherein for anchoring said anchoring head into the excavation wall at the level of the bore drilled therein, said actuation member and said expansion member must be moved relative to one another so as to enter into contact with one another, and in such a way as to enable said actuation member to exert a pressure on said expansion member to generate radial expansion of at least one portion of the latter, so that said portion of said expansion member comes to frictionally abut against a part of the internal surface circumscribing the drilled bore in the excavation wall.

In a first embodiment of the invention, the anchoring device is characterized in that said expansion member is an elastic expansion sheath of cylindroid shape defining a first end and a second end, and an interior cavity engaged by said support member.

In one of the embodiments of the invention, the anchoring device is characterized in that said support member is an elongated rigid rod, defining a longitudinal axis extending in between said distal and proximal ends thereof.

In one of the embodiments of the invention, the anchoring device is characterized in that said elongated rigid rod is at least partly threaded, and wherein said actuation member defines a longitudinal interior cavity having a peripheral wall being also at least partly threaded and threadedly engages said rod, and in that said rod is pivotable around said longitudinal axis to generate a displacement of said actuation member threadingly axially along said rod, to enable relative displacement of said actuation member relative to said expansion sheath.

In one of the embodiments of the invention, the anchoring device is characterized in that said cavity of said expansion sheath defines a first mouth proximate to said first end of said expansion sheath, and wherein said actuation member comprises an insertion member movable axially along said rod when the latter is pivoted around its longitudinal axis, said insertion member at least partially engageable into said interior cavity of said expansion sheath by said first mouth, to apply radially outward pressure on a peripheral surface of said interior cavity of said expansion sheath at least proximate to said first end thereof, to generate stretching and radial expansion of said expansion sheath at least proximate to said first end thereof.

In one of the embodiments of the invention, the anchoring device is characterized in that said insertion member is an insertion wedge comprising a frusto-conical portion, said insertion wedge at least partially engageable into said internal cavity of said expansion sheath by said first mouth thereof to generate expansion and radial stretching of said expansion sheath at least proximate to said first end thereof.

In one of the embodiments of the invention, the anchoring device further comprises a retention member mounted stationary onto said rod, said second end of said expansion sheath being abuttable against said stationary retention member when said insertion wedge engages into said first mouth of the interior cavity to radially outwardly stretch said expansion sheath.

In one of the embodiments of the invention, the anchoring device is characterized in that said cavity of said expansion sheath defines a second mouth opposite said first mouth and located proximate to said second end of said expansions sheath, wherein also said retention member comprises a second insertion wedge defining a second frusto-conical portion, said second insertion wedge engageable into said second mouth of said cavity of said expansion sheath when said insertion wedge moves toward said expansion sheath and pushes the latter toward said second insertion wedge.

In one of the embodiments of the invention, the anchoring device further comprises a retention member mounted stationary on said rod, and wherein said actuation member is a push member movable along said rod and which can push said expansion sheath against said retention member so as to axially compress said expansion sheath and to generate radial expansion thereof.

In one of the embodiments of the invention, the anchoring device further comprises a hollow sheath engaged by said rod and maintained in axially stationary fashion thereon, and defining a main cylindrical portion and a rear annular stopper projecting radially outwardly from one of the ends of said main cylindrical portion, said rear stopper forming said retention member, said main cylindrical portion of said sheath engaging said interior cavity of said expansion sheath.

In one of the embodiments of the invention, the anchoring device is characterized in that said push member comprises an expansion shell having a first end portion being annular and hollow and slidingly engaging said main cylindrical portion of said sleeve, so that said expansion sheath can become wedged between said annular end portion of said expansion sheath and said rear stopper of said sleeve, said expansion shell further comprising a number of blades having a toothed exterior surface, said push member further comprising an insertion wedge movably threadingly mounted to said threaded rod and movable toward said expansion shell, both to engage between said blades of said expansion shell and to generate their spreading apart to enable their being applied against the peripheral surface circumscribing the drilled bore in the excavation wall, and to slidingly push said first end portion of said expansion shell along said main cylindrical portion of said sleeve and against said expansion sheath and to generate axial compression of the latter, and consequently the radial expansion thereof to enable its being applied against the peripheral surface circumscribing the drilled bore in the excavation wall.

In one of the embodiments of the invention, the anchoring device is characterized in that said bearing member is a bearing plate.

In one of the embodiments of the invention, the anchoring device is characterized in that said rod is provided with at least two anchoring heads to increase the number of anchoring points along the drilled bore in the excavation wall, so that said anchoring device may resist to stronger loads.

In one of the embodiments of the invention, the anchoring device is characterized in that said expansion sheath comprises at least one elongated band fixedly secured to an exterior surface of said expansion sheath.

The present invention also relates to an anchoring device for stabilising an excavation wall from a rocky bed, and to be at least partially engaged into a bore drilled into the excavation wall, said anchoring device comprising:

an adjustable diameter tube, for engagement into the drilled bore in the excavation wall, and having an exterior surface for applying a radially outward pressure on the internal surface of the bore;

a bearing member mounted on said tube proximate to a proximal end thereof, for bearing against an exterior surface of the excavation wall;

an elongated rigid rod defining a distal end engaged into said tube, and a proximal end opposite said distal end thereof, said rod defining a longitudinal axis extending between said distal and proximal ends thereof; and an anchoring head mounted on said rod and engaged into said tube, said anchoring head comprising:

a flexible expansion member mounted on said rod, made from an elastic material and adapted to stretch and radially widen; and an actuation member movably mounted on said rod, said actuation member mounted for relative movement to said rigid rod and to said expansion member and engageable with the latter, said actuation member adapted to exert a pressure on said expansion member; wherein to bring into operational condition said anchoring device, said rod and said anchoring head must be engaged into said tube, said tube having previously been engaged into the drilled bore of the excavation wall, and then said actuation member and said expansion member must be moved relative to one another for engagement with one another, so as to enable said actuation member to apply a pressure on said expansion member to generate radial expansion of at least a portion of the latter, so that said portion of said expansion member come to apply a radial pressure against an internal surface of the tube to enable increase of the pressure applied by said external surface of said tube against the internal surface of the bore.

The present invention also relates to an anchoring head to be installed onto a rigid rod, and adapted to be anchored into a bore drilled into an excavation wall from a rocky bed, said anchoring head comprising::

a flexible expansion member for mounting onto the rod, made from an elastic material and stretchable and which can be radially widened; and an actuation member movably mounted on said rod, said actuation member mounted for relative movement to said expansion member and engageable with the latter, said actuation member adapted to exert a pressure on said expansion member; wherein for anchoring said anchoring head into the rocky bed at the level of the bore drilled in the excavation wall, said actuation member and said expansion member must be moved relative to one another so as to enter into contact with one another, and in such a way as to enable said actuation member to exert a pressure on said expansion member to generate radial expansion of at least one portion of the latter, so that said portion of said expansion member comes to frictionally abut against a peripheral internal surface circumscribing the drilled bore of the excavation wall.

The present invention also relates to a method for making integral an unstable rocky bed, this rocky bed comprising an uneven exterior surface circumscribing an access shaft, said method comprising the following steps:

a) using a drilling machine to drill at least one elongated cavity through said exterior surface and into the rocky bed, the rocky bed forming an interior surface circumscribing said drilled elongated cavity, and an annular portion of said exterior surface opening onto said access shaft;

b) providing an anchoring device comprising a rigid elongated rod defining a first distal end mounted into said elongated cavity, a proximal end portion projecting outwardly from said elongated cavity, said anchoring device further comprising a elastic expansion member mounted on said rod, wherein said expansion member may be in a first unloaded condition, and may become frictionally engageable with said interior surface of rocky bed when biased in a second compressed condition, said anchoring device further comprising an actuation member movably mounted on said rod proximate said expansion member, said anchoring member further comprising, on said proximal end portion of said rod, a bearing member and also a tension biasing device;

c) engaging at least a portion of said rigid rod into said elongated cavity, starting with said distal end portion thereof, so that said elastic expansion member and said actuation member mounted onto said rod are also engaged into said cavity, so that said bearing plate and said tension biasing device release said cavity and be located proximate said annular part of said exterior surface of the rocky bed;

d) moving said movable actuation member along said rod to engage said elastic expansion member so as to bias said expansion member to said second compression condition thereof; and e) adjusting said tension biasing device so that the latter frictionally engages said bearing member against said annular portion of exterior surface of rocky bed.

The present invention also relates to an anchoring device for an unstable excavation wall, this rocky bed being of the type comprising an uneven exterior surface, circumscribing an access shaft, and at least one cavity drilled through this exterior surface and into the rocky bed, said device comprising:

an elongated rigid rod, for engagement into this drilled bore, said rod comprising a distal part to be mounted into this drilled cavity, a proximal part for projecting outwardly from this drilled cavity, and an intermediate part located between said distal part and said proximal part;

an elastic expansion member, mounted on said intermediate part of said rod, said expansion member adapted to clear the interior surface of rocky bed in a first unbiased condition, but frictionally engageable with this interior surface of rocky bed once biased into a second compression condition;

a movable actuation member of said expansion member, mounted on said rod;

a bearing member, mounted on said proximal end part of said rod; and a tension biasing device, mounted on said proximal end part of said rod, for frictional engagement of said bearing member against said annular part of exterior surface of rocky bed.

DETAILED DESCRIPTION OF THE EMBODIMENTS OF THE INVENTION

Figure 1:
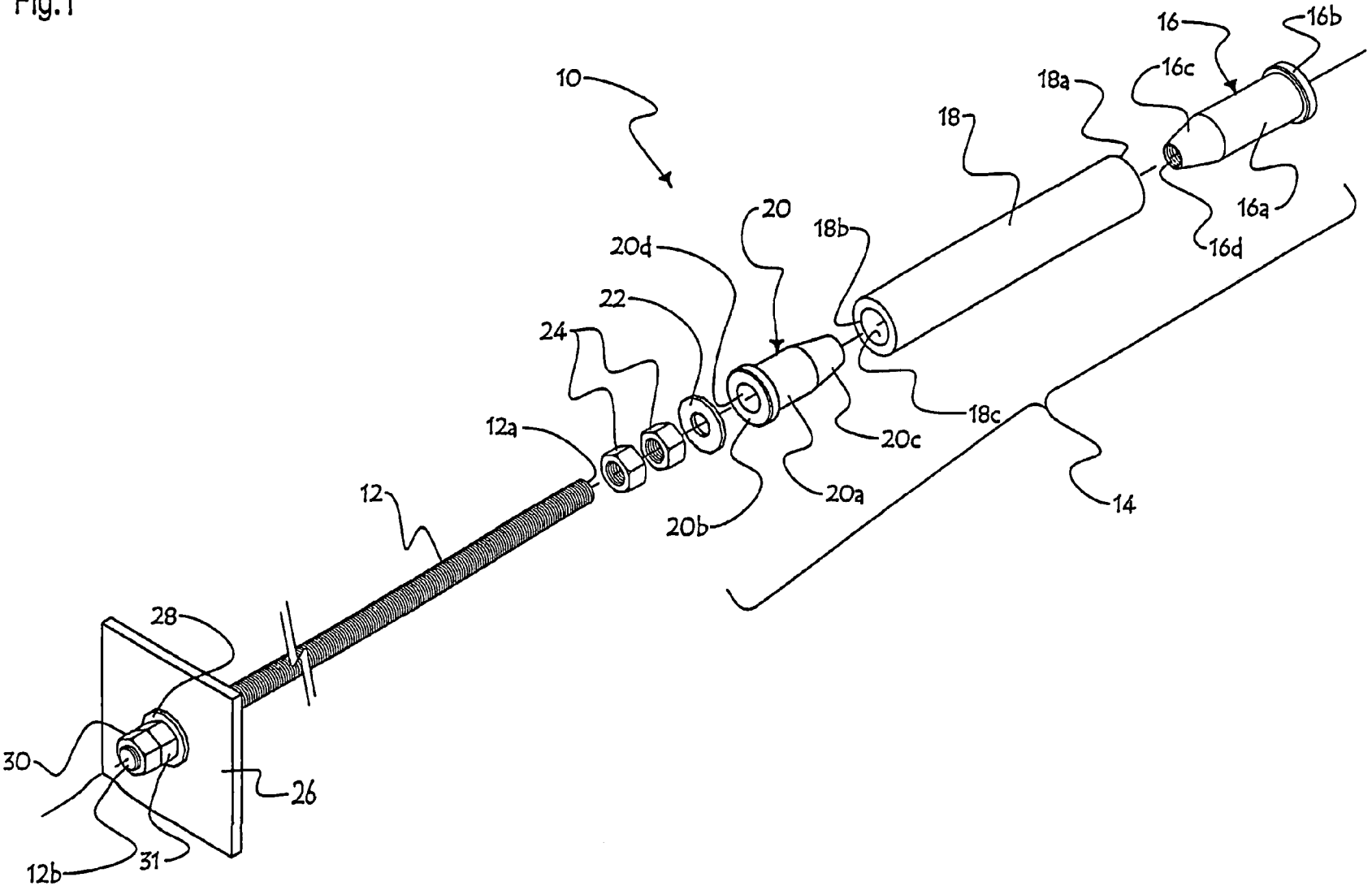
FIG. 1 shows a perspective exploded view of an anchoring bolt according to a first embodiment of the invention.
Figure 2:
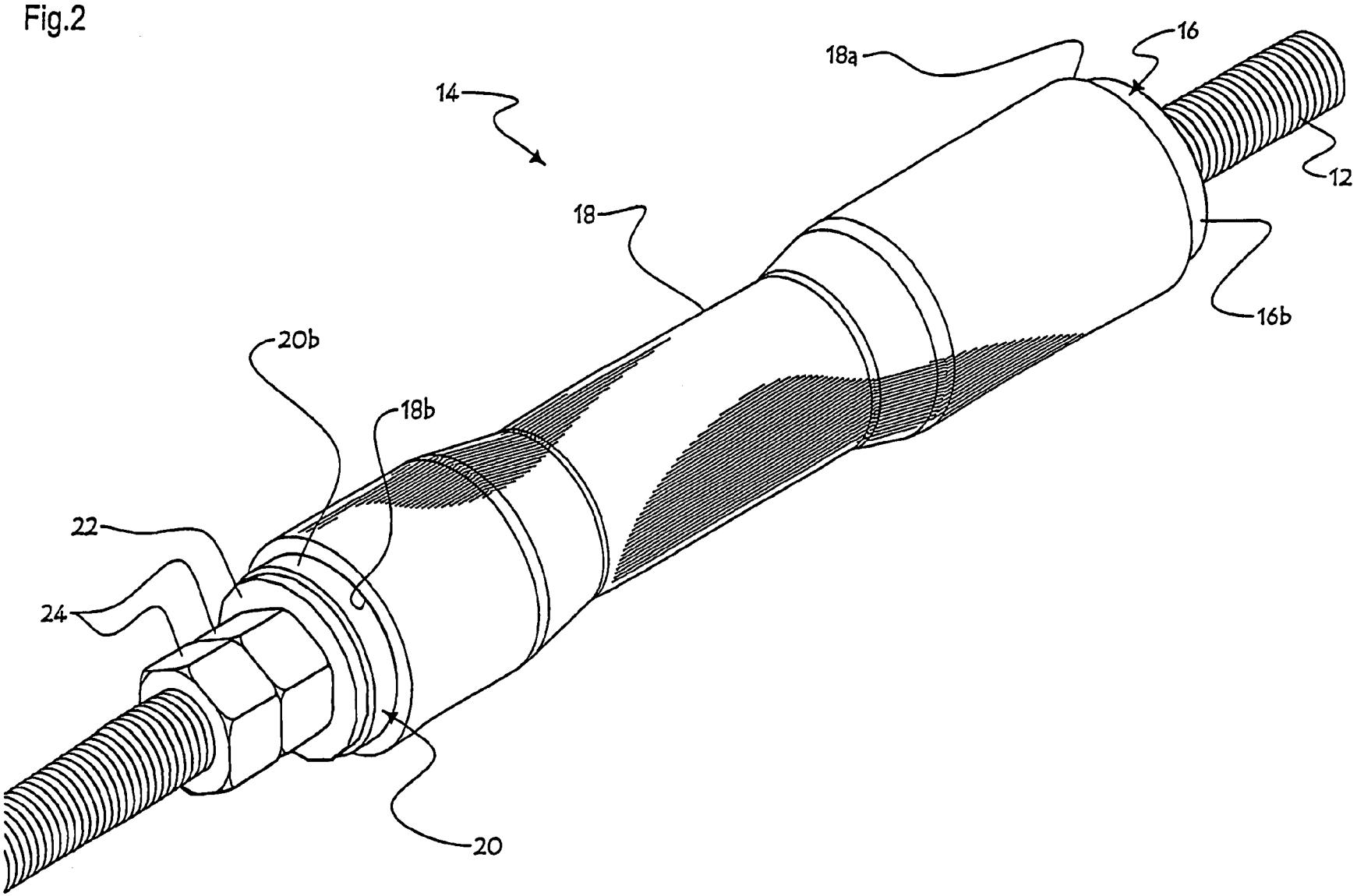
FIG. 2 is an enlarged perspective view showing in particular the anchoring head of the anchoring bolt from FIG. 1.

FIGS. 1-12 show several embodiments of the anchoring device of the present invention. Although these anchoring devices may be used on all sorts of walls requiring support, such as a concrete wall or the wall of a cliff, the present description, to facilitate reading, will deal only with their use to support a rocky excavation wall, for example in a mine.

FIGS. 1-3*b* show an anchoring bolt 10 according to one of the embodiments of the invention. Anchoring bolt 10 comprises a rigid threaded rod 12, also called stud bolt 12, and defining a distal end 12*a* and a proximal end 12*b*. Stud bolt 12 may have for example a length of ½ to 3 meters, depending for example on the purpose of the anchoring bolt 10.

An anchoring head 14 is mounted on the stud bolt 12, for example proximate its distal end 12*a*. This anchoring head 14 is destined to be engaged into a bore drilled into an excavation wall.

The anchoring head 14 comprises an expansion member having the shape of a tubular, elongated and cylindroid expansion sheath 18, mounted on the stud bolt 12 so that the peripheral surface of its tubular interior cavity 18*c* surround the stud bolt 12 and quite freely engage the stud bolt 12 without becoming tightened around same.

This anchoring head 14 further comprises two insertion wedges: a movable insertion wedge 16, and a stationary insertion wedge 20, both mounted on the stud bolt 12 on opposite sides of the expansion sheath 18. The insertion wedges 16 and 20 may have or may not have the same length. Each of these insertion wedges 16, 20, define a generally cylindrical main portion 16*a*, 20*a*, respectively, a rear annular stopper 16*b*, 20*b* projecting radially outwardly and rearwardly of the main cylindrical portion 16*a*, 20*a*. Moreover, these insertion wedges 16, 20, each comprise a frusto-conical portion 16*c*, 20*c* having a tip shape, projecting axially forwardly of the main cylindrical portion 16*a*, 20*a*. The tip of frusto-conical portion 16*c* of the movable insertion wedge 16 is directed toward the distal mouth 18*a* of the interior cavity 18*c* of the expansion sheath 18; similarly, the tip of the frusto-conical portion 20*c* of the stationary insertion wedge 20 is directed toward the proximal mouth 18*b* of the interior cavity 18*c* of the expansion sheath 18.

The free end of the frusto-conical portion 16*c*, 20*c*, of the insertion wedges 16, 20, has a smaller diameter than that of the cylindrical interior cavity 18*c* of the expansion sheath. On the other hand, the frusto-conical part 16*c*, 20*c*, progressively widens toward the main cylindrical part 16*a*, 20*a*, of the insertion wedges, whose diameter is larger than that of the cavity 18*c*.

Each of these insertion wedges 16, 20, is tubular, and define an interior cavity 16*d*, 20*d*. The interior cavity 16*d* of the movable insertion wedge 16 is threaded, and the movable insertion wedge 16 is threadedly mounted onto the stud bolt 12; the threads of this threaded cavity 16*d* will cooperate with the threads of the stud bolt 12, when the latter is pivoted about its longitudinal axis, to enable axial displacement of the movable insertion wedge 16 relative to the stud bolt 12, as more particularly disclosed hereinafter. With respect to the interior cavity 20*d* of the stationary insertion wedge 20, there is defined a peripheral smooth unthreaded surface. This cavity 20*d* is engaged by the stud bolt 12, and the rear stopper 20*b* of wedge 20 abuts against an O-ring 22, maintained axially stationary by two nuts 24, 24 screwed onto stud bolt 12 and firmly tightened one against the other. When the stud bolt 12 is rotated around its longitudinal axis, the two nuts 24, 24, become integral in rotation with the stud bolt 12, and thus do not move axially along the stud bolt 12. Hence, when the stud bolt 12 is rotated around its longitudinal axis, the rear surface of the insertion wedge 20 slides on O-ring 22, and the anchoring head 14 cannot move toward the proximal end of stud bolt 12 beyond the axially stationary assembly relative to the stud bolt 12 formed by the two nuts 24, 24, threadedly tightened one against the other.

Figure 3A:
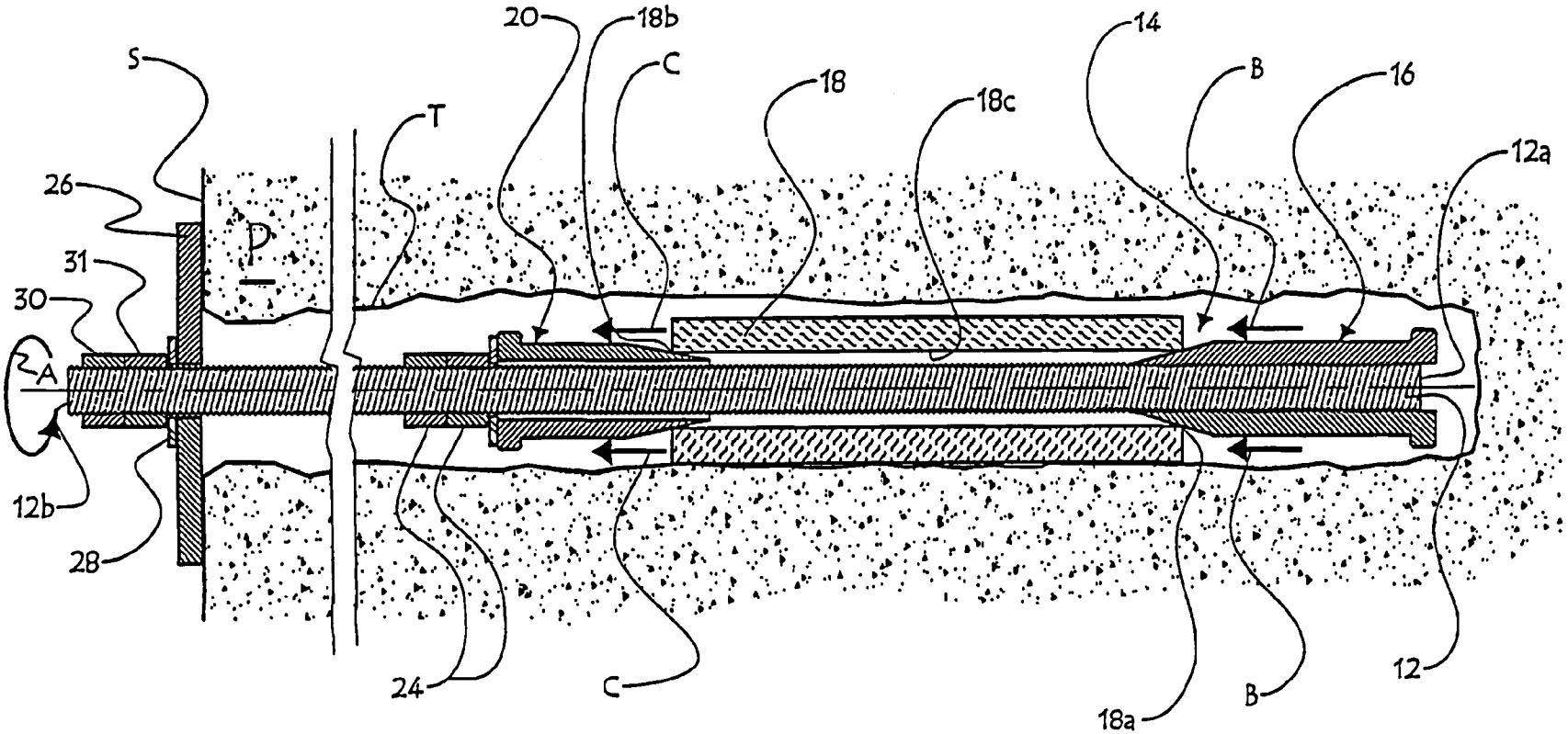
FIGS. 3*a* and 3*b* are broken vertical sectional views of a rocky bed, showing in transverse sectional view the anchoring bolt of FIG. 1, and suggesting the installation sequence of this anchoring bolt in a horizontal bolt drilled into this rocky bed.
Figure 3B:
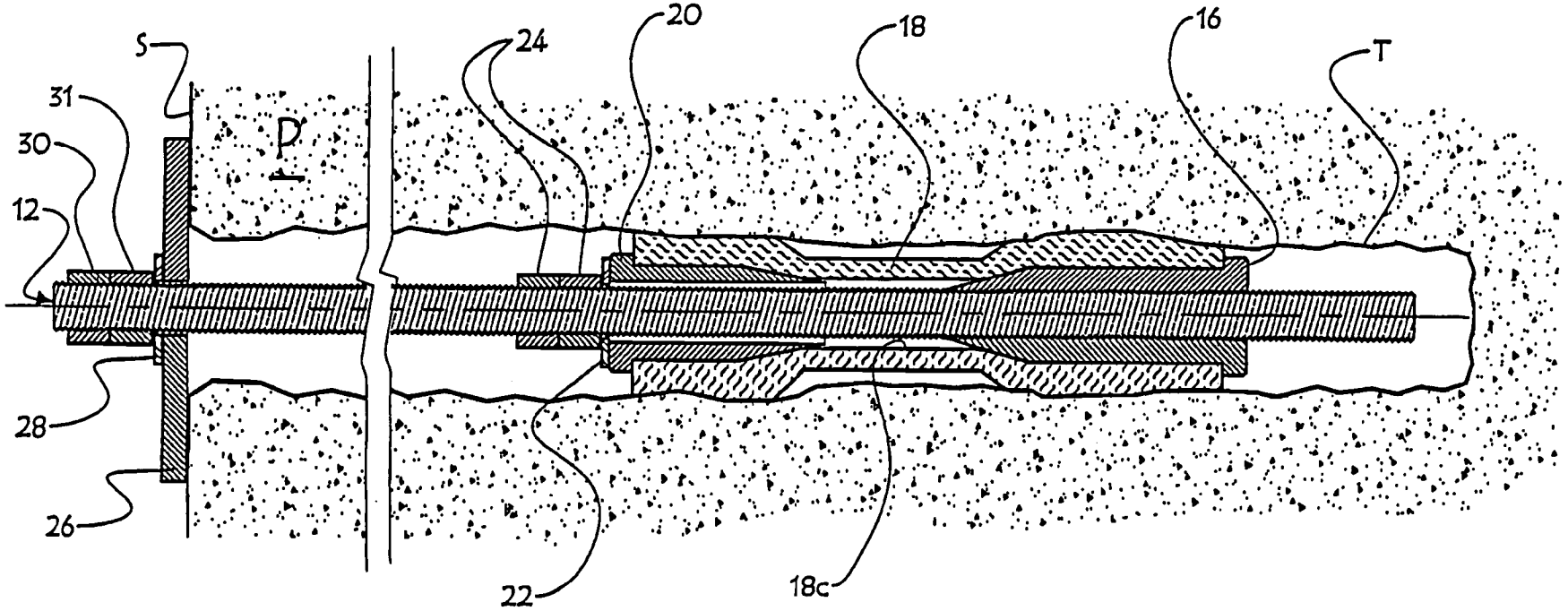
Figure 4:
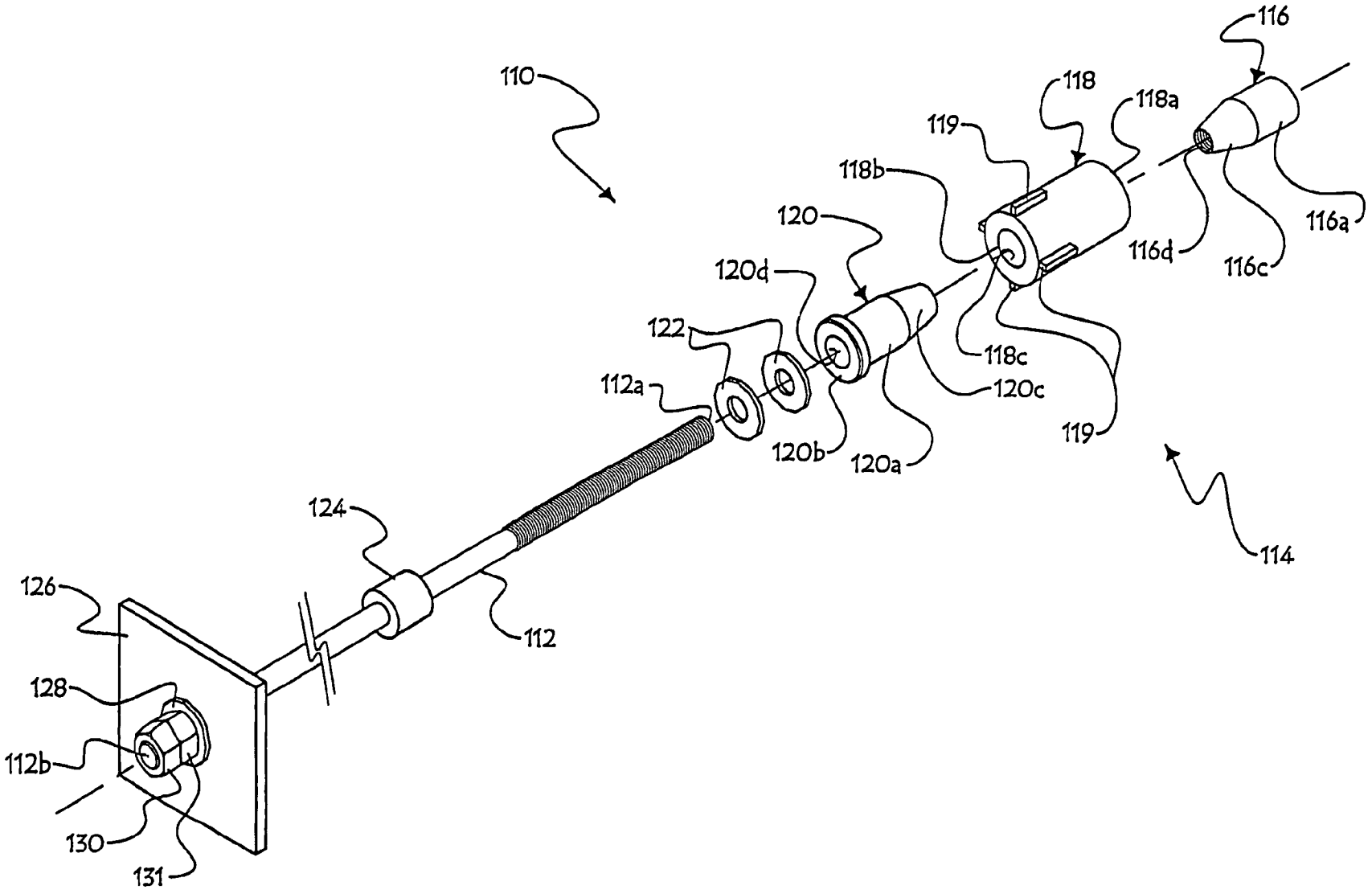
FIG. 4 shows a perspective exploded view of an anchoring bolt according to a second embodiment of the invention.
Figure 5:
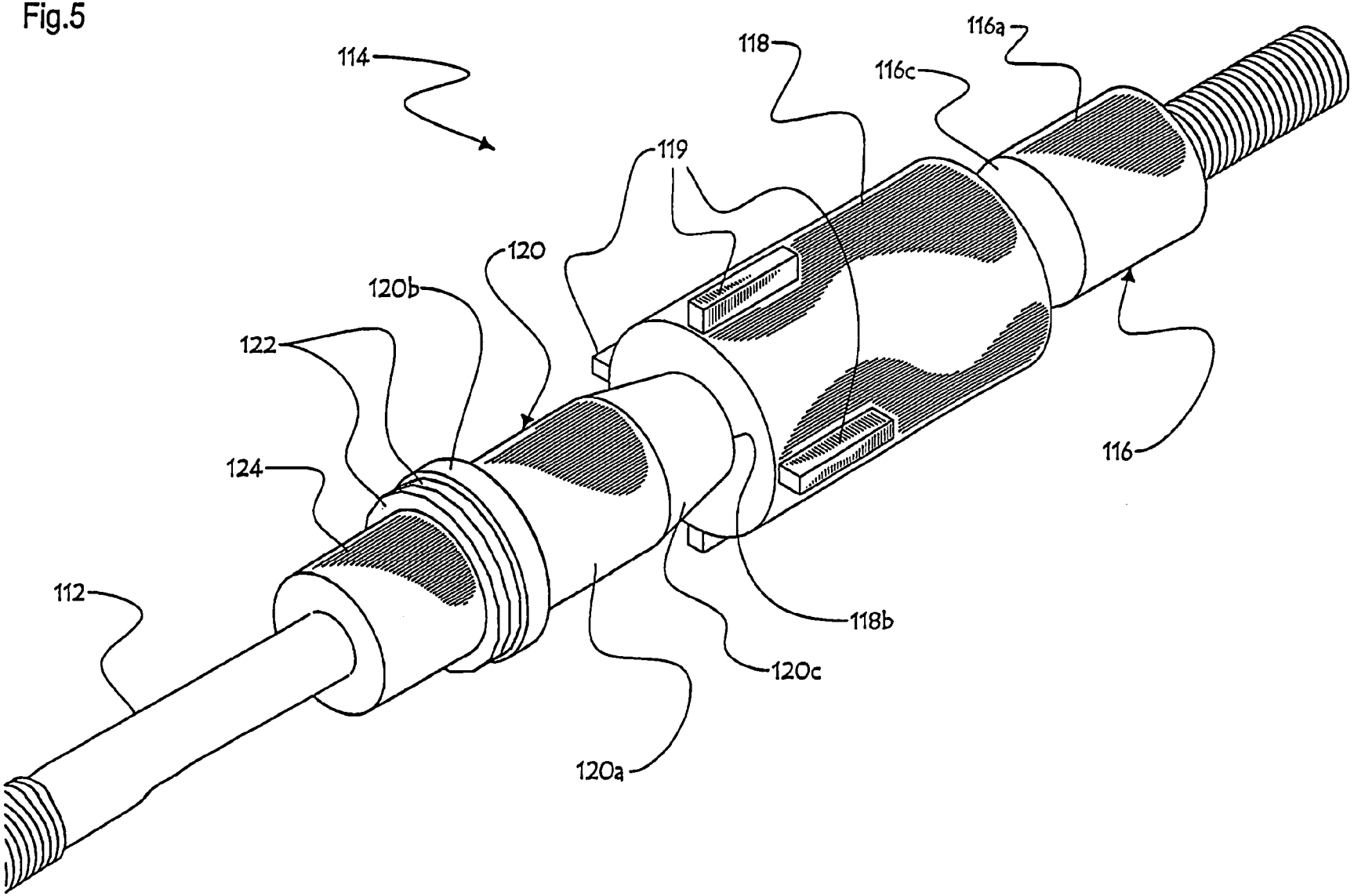
FIG. 5 is an enlarged perspective view showing in particular the anchoring head of the anchoring bolt of FIG. 4.

The insertion wedges 16, 20, may forcibly engage into cavity 18*c* of the expansion sheath 18, to induce stretching and thus radial expansion of the latter. When the different components of the anchoring head 14 are mounted in such a way that the expansion sheat 18 is not radially stretched by the insertion wedges 16, 20, this will hereinafter be referred to as the rest position of the anchoring head 14 (as shown in FIG. 3*a*). When the sheath 18 is radially stretched by the insertion wedges 16, 20, this will hereinafter be referred to as the operative position of the expansion sheath 18 (FIG. 3*b*).

The stud bolt 12, proximate its proximal end 12*b*, is provided with a conventional bearing plate 26, bored in its center and engaged by the stud bolt 12. This plate, when the anchoring bolt 10 is placed in a bore drilled into the wall of an excavation, will come to bear against the exterior surface of the wall of excavation P (FIG. 3*a*-3*b*) to load the anchoring bolt 10. Moreover, an O-ring 28 and two nuts 30, 31, are mounted on the stud bolt 12 between the bearing plate 26 and the proximal end 12*b* of the stud bolt. The two nuts 30, 31, screwed and tightened against one another forming a stationary assembly relative to the stud bolt 12, i.e. are integral in rotation with the stud bolt 12, will enable a rotating tool to grasp the stud bolt 12 by its part projecting from the excavation wall and located exteriorly of the drilled bore, and to rotate same around its longitudinal axis. Moreover, these nuts 30, 31, will serve to tighten the bearing plate 26 against the excavation wall.

The method of installation of the anchoring bolt 10 will now be detailed. Before installation of the anchoring bolts on the excavation wall, the latter should be prepared to enable same to accommodate them. First of all, as already explained in the hereinabove "Background of the invention" section, the wall P of the excavation must be purged of all unstable rocky blocks that could tend to detach therefrom. Thereafter, an elongated bore T (FIGS. 3*a*-3*b*) must be bored in the rocky wall of the excavation P; this bore may be bored with a rock drill having a combined rotation/percussion movement and provided with a screw auger, for example. This bore T is preferably bored orthogonally to the exterior surface S of the excavation wall, and should have a depth corresponding to the bolt length; typically, bore T is drilled so as to be longer by about 10 centimetres (4 inches) relative to the stud bolt. The diameter of bore T should be such that it is slightly larger than the diameter of the expansion sheath 18 when the anchoring head 14 is in rest position, i.e. when the expansion sheath 18 is not radially stretched by the insertion wedges 16, 20.

Once this bore T has been made in the excavation wall, the anchoring bolt 10 may be installed therein. Before engagement in the bore T of the stud bolt 12 provided close to the distal end 12*a* of the anchoring head 14, the anchoring head must be previously adjusted. It must be adjusted so as to reach its rest position, as illustrated in FIG. 3*a*. In this rest position, the frusto-conical portion 16*c*, 20*c*, of the insertion wedges 16, 20, must be partly engaged in the cavity 18*c* of the expansion sheath 18, so that the external surface of these frusto-conical portions 16*c*, 20, frictionally abut against the peripheral wall of the cavity 18*c* of the expansion sheath 18, without however this latter being radially stretched by the insertion wedges 16, 20. This adjustment may be performed by manually screwing the movable insertion wedge 16 so that it progressively moves toward the distal mouth 18*a* of the cavity 18*c* of expansion sheath, and this until the expansion sheath 18 becomes slightly wedged between the two insertion wedges 16, 20.

The stud bolt 12 provided with the anchoring head 14 in rest position, is thereafter sunk into the bore T. When the anchoring head 14 in rest position is engaged into the bore T, the expansion sheath 18 which is diametrally smaller than bore T, is frictionally applied under gravity against the lower rough part of the bore T. This is apparent from the sectional view of FIG. 3*a*, where the lower surface of sheath 18 is applied against the hollow of bore T.

Afterward, stud bolt 12 must be rotated around its longitudinal axis (as suggested by arrow A on FIG. 3*a*) in a given direction. A suitable rotating tool (not shown on the drawings) is used to perform this rotation of the stud bolt, for example the rock drill previously used for the drilling of the bore T in the rock bed, but now provided with a nut socket rather than a screw auger. The socket of this rotary tool must engage nut 30, and the tool must be actuated to transfer to this nut a rotational motion. Since the nut 30 is screwed against the adjacent nut 31, rotation of nut 30 does not induce a screwing movement on the latter onto the stud bolt 12, but rather rotation of the stud bolt 12 around its longitudinal axis, integral with nut 30 brought into rotation by the rotary tool.

When the stud bolt 12 is pivoted around its longitudinal axis, the expansion sheath 18 does not pivot since it frictionally abuts against the rough surface circumscribing the bore drilled in the rock, and the frictional engagement of the expansion sheath 18 against the rock surrounding the bore T allows by itself the expansion sheath to avoid rotation with the stud bolt 12. Moreover, the movable insertion wedge 16 frictionally abuts against the expansion sheath 18, and the frictional engagement by itself of the movable insertion wedge 16 against the expansion sheath 18 allows retention of the movable insertion wedge 16 to prevent the latter from being brought in rotation together with the stud bolt 12. In this way, the movable insertion wedge 16 remains stationary relative to the expansion sheath 18 and relative to the rocky surface surround the bore T when the stud bolt 12 is pivoted, which will allow a relative pivotal movement of stud bolt 12 to be generated relative to the movable insertion wedge, and by way of consequence, to generate the screwing motion of the insertion wedge 16 (whose interior cavity 16*d* is threaded) relative to the stud bolt 12 (whose exterior surface is threaded).

Hence, by pivoting in a given direction the stud bolt 12 when the latter is sunk into the bore T and when the anchoring head 14 is adjusted in its rest position, screwing of the insertion wedge 16 on the stud bolt 12 may be initiated, and thus generate axial displacement of the movable insertion wedge 16 toward the expansion sheath 18, as suggested by the arrows B on FIG. 3*a*. Clearly, the direction toward which stud bolt 12 should be pivoted to generate the displacement of the insertion wedge 16 toward the expansion sheath 18 depends upon the orientation of the threads made thereon. This axial displacement allows on the one hand to push the expansion sheath 18 toward the stationary insertion wedge 20 (as suggested by arrows C in FIG. 3*a*), so that the expansion sheath 18 engage and surround at least partially around the insertion wedge 20. Moreover, the axial displacement of the movable insertion wedge 16 concurrently allows its progressive engagement into the mouth 18*a* of the cavity 18*c* of the expansion sheath 18, until its frusto-conical portion 16*c* and/or its main cylindrical portion 16*a* become at least partly engaged therein.

Since the exterior diameter of the main cylindrical portions 16*a*, 20*a*, of the insertion wedges 16, 20, is larger than the diameter of the interior cavity 18*c* of the expansion sheath 18, such an engagement of the insertion wedges 16, 20, into the cavity 18*c* of the expansion sheath 18 induces stretching and radial expansion of at least a portion thereof, and thus the tilting of the anchoring head in operative position, in which the expansion sheath 18 is tightly applied against the interior surface of bore T drilled in the excavation wall, as shown in FIG. 3*b*. A strong frictional force is thus generated between the expansion sheath 18 and the rocky surface surrounding the bore T on which it is compressed, which enables a firm anchoring of the anchoring head 14 to the rock circumscribing the bore T.

Pivotal motion of the stud bolt 12 should continue until pivotal resistance, which is a function of the pressure radially applied by anchoring head 14 against the interior surface of the bore drilled into the rock, reaches a threshold value. Once this threshold value has been reached, the anchoring head is deemed anchored to the rocky bed.

Once the anchoring of the anchoring bed 14 in the rock is completed, the plate 26—which remained spaced from the surface S of the excavation wall P—must be applied against the surface S of the excavation wall P, and must be maintained pressed against same by successively screwing nut 31 and then nut 30 toward the bearing plate. Once the bearing plate 26 becomes abutted and is tightened against the surface of the excavation wall, the anchoring bolt 10 is loaded and thus becomes operational, and thereafter contributes to the support of excavation wall P.

Figure 11:
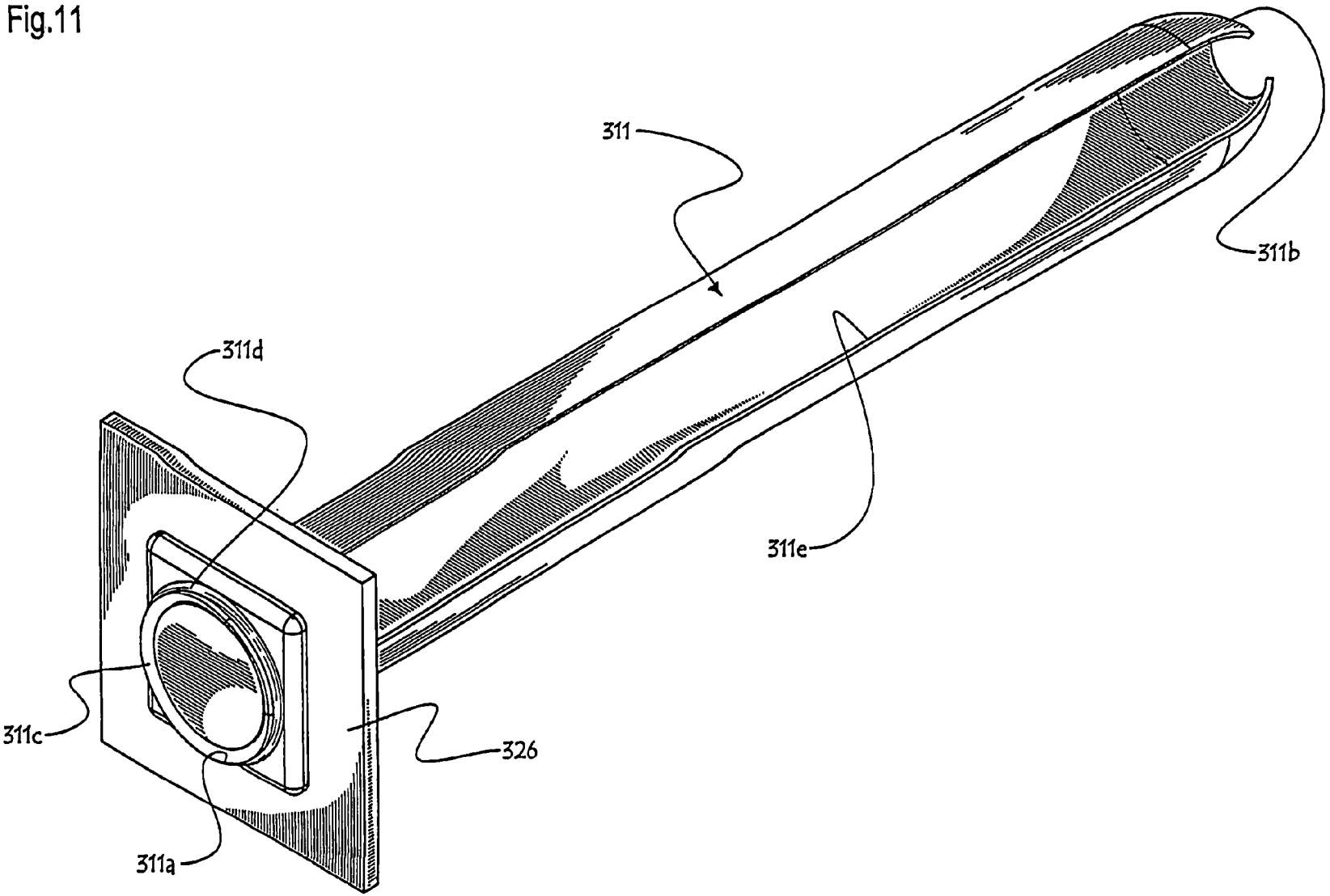
FIG. 11 is a perspective view of an anchoring bolt of the "Split Set" type.
Figure 12:
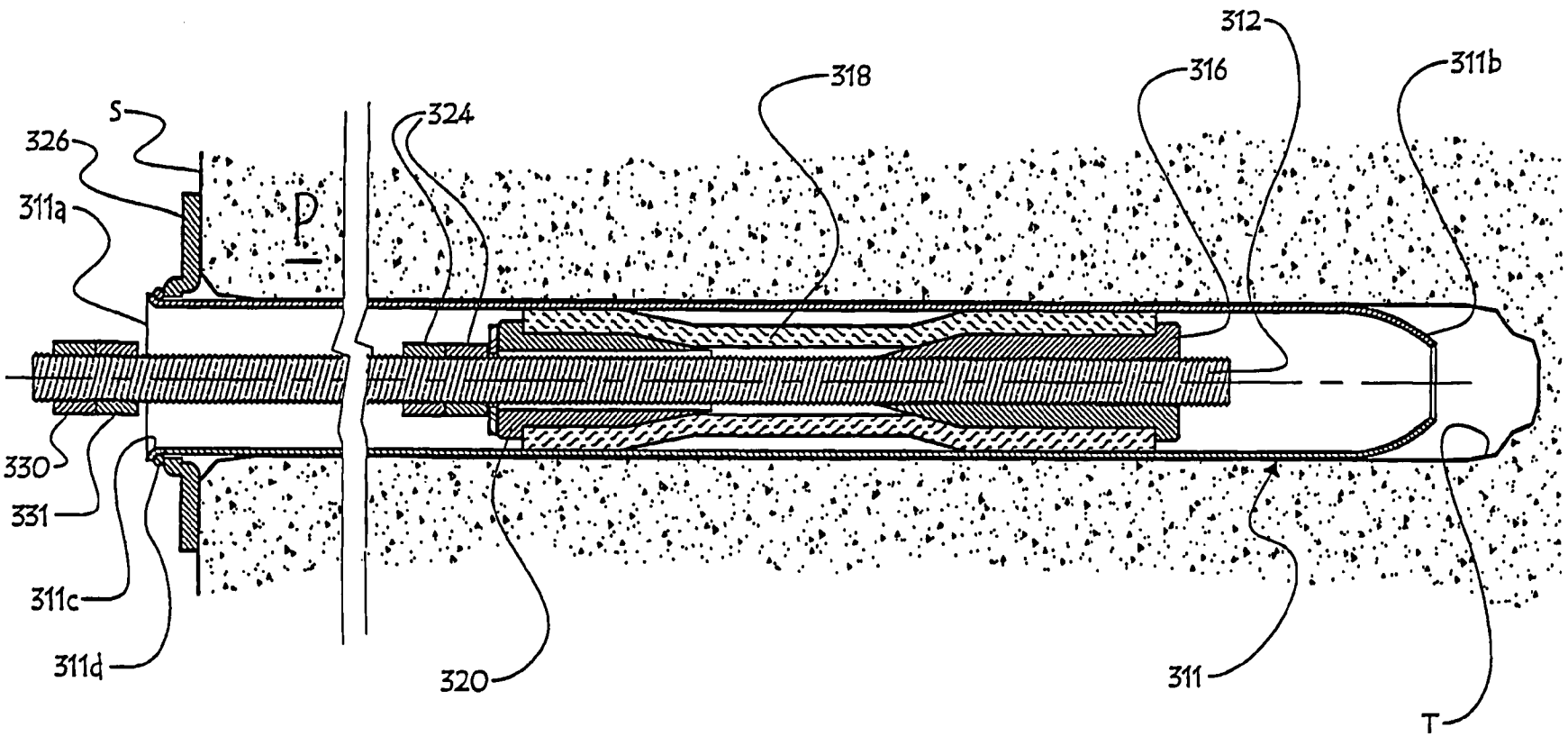
FIG. 12 is a transversely sectional view of a fifth embodiment of the present invention, combining an anchoring bolt of the "Split Set" type and an elastic sheath anchoring bolt similar to that of FIG. 1, mounted into a bore drilled inside a rocky bed shown in vertical sectional view.
Figure 13:
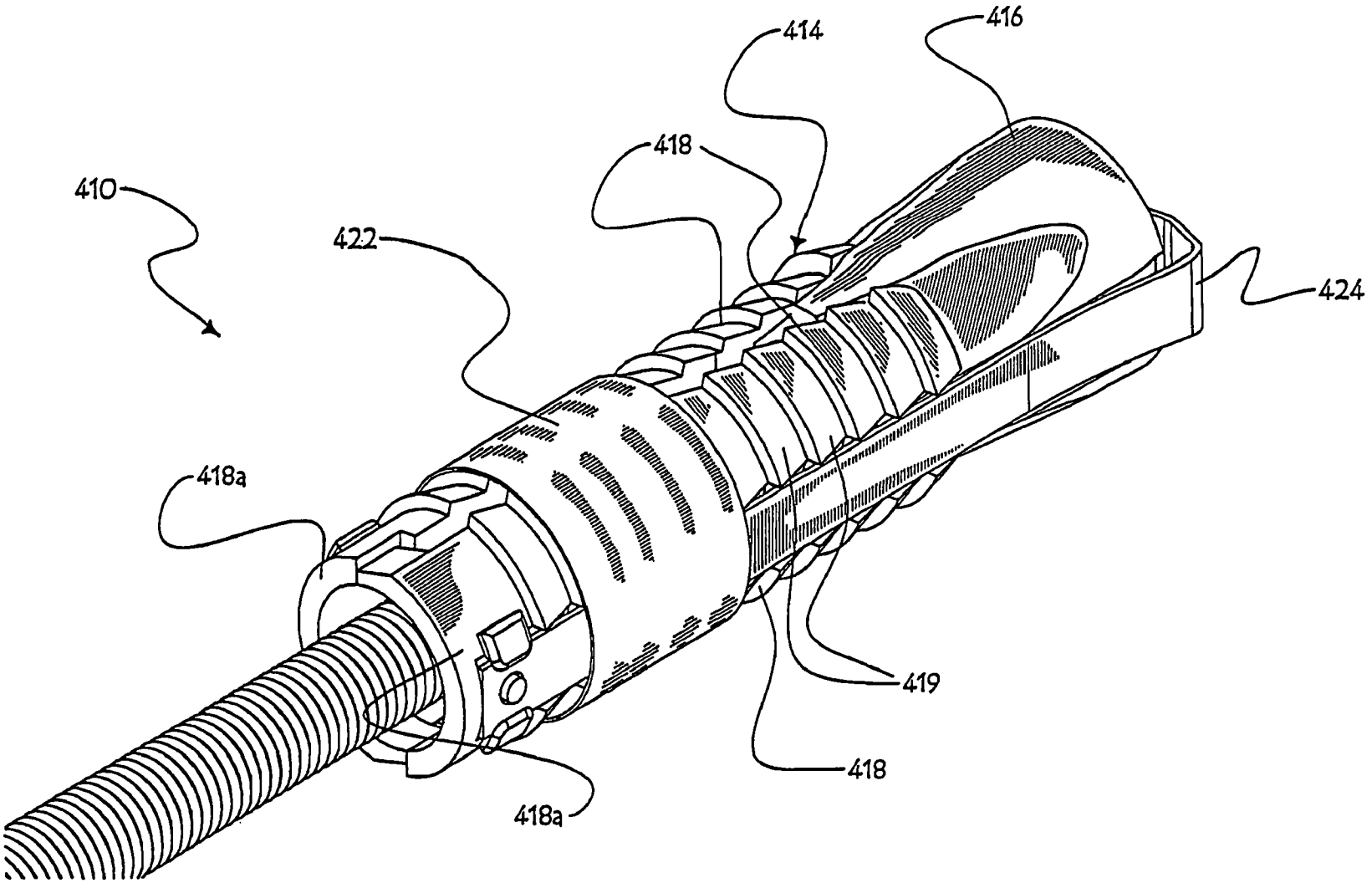
FIGS. 13 and 14 show enlarged rear and front perspective views, respectively, of an expansion shell anchoring head as taught by prior art.
Figure 14:
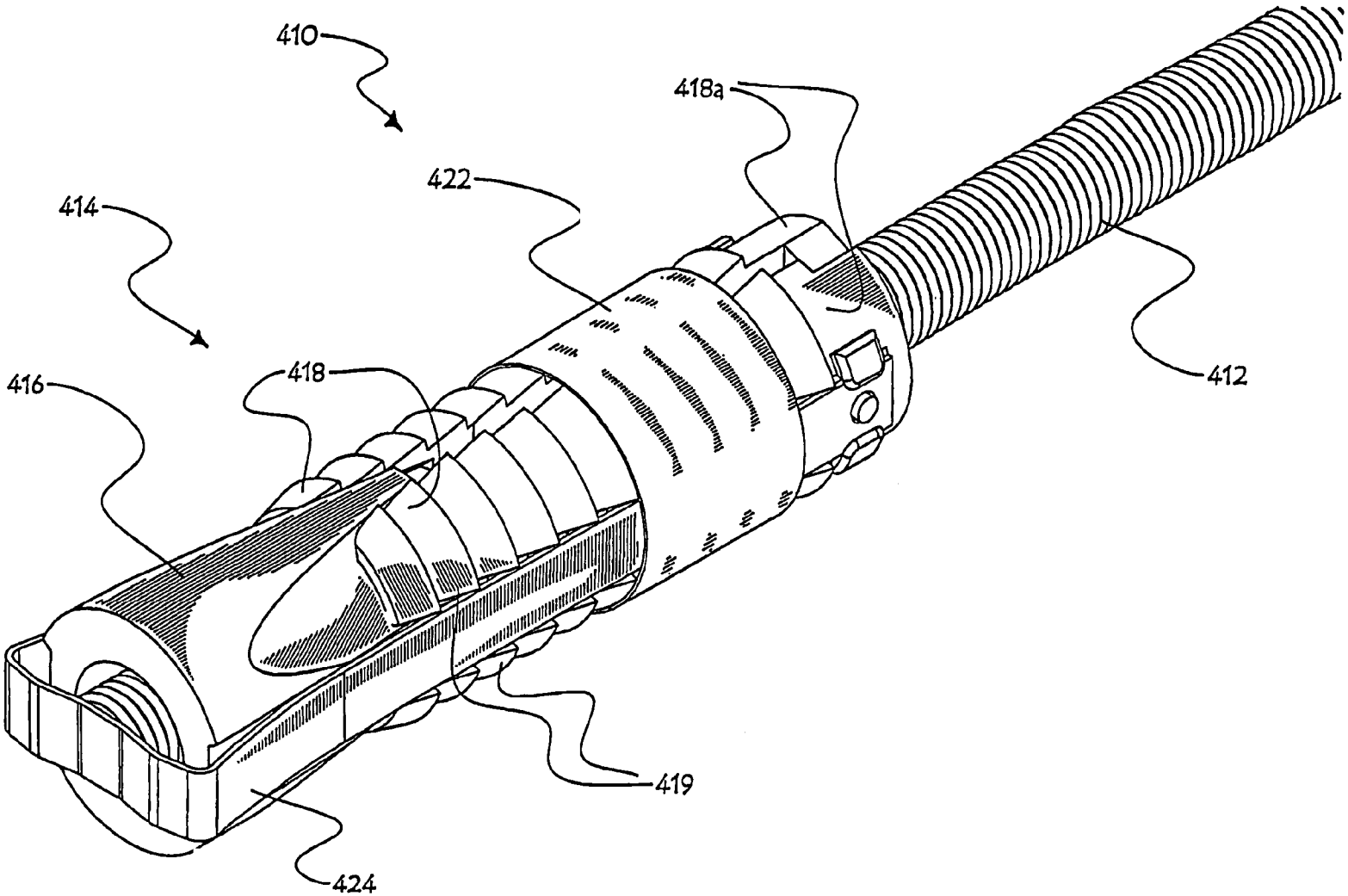

The anchoring bolt of the invention, such as the anchoring bolt 10 of FIGS. 1-3*b* for example, discloses several advantages relative to conventional mechanical anchoring bolts (also called rockbolt), such as the one shown in FIGS. 11 and 12. The anchoring bolt 410 of FIGS. 13-14, also discussed in the hereinabove "Background of the invention" section, comprises a stud bolt 412 and an expansion shell 414 mounted close by to the distal end of the stud bolt 412. This expansion shell 414 consists of four blades 418 interconnected to one another by their end 418*a*, then maintained together by a ring 422. These blades surround the stud bolt 412, and their exterior surface is made rough by a plurality of teeth 419 having a triangular cross section, as shown on FIGS. 13 and 14. The four blades 418 are maintained at the distal end of the stud bolt by a U-shape retention member 424. A cone-shaped movable insertion wedge 416 is screwingly mounted to the distal end of stud bolt 412. By pivoting stud bolt 412 toward a given direction relative to insertion wedge 416, the latter will move under screwing action along the stud bolt 412 toward the four blades 418, and may engage between the four blades 418 to generate their spreading apart.

When the bolt 410 is mounted in a bore drilled into a rocky excavation wall for the support thereof and when the stud bolt is pivoted relative to the expansion wedge, the expansion shell will open up, i.e. that the four blades 418 will spread apart and will progressively move away from the stud bolt 412, and the teeth 419 will apply a pressure and will grip the peripheral internal surface of the bore drilled into the excavation wall. A conventional bearing plate (not shown), mounted close by to the proximal end (not shown) of stud bolt 412, is then screwed against the exterior surface of the excavation wall, to load the anchoring bolt 410.

Such an anchoring bolt with toothed blades has several drawbacks. Indeed, the grip of toothed blades 418 is limited on the rocky surface circumscribing the drilled bore, i.e. that only the tip of the teeth 419 which bite discretely onto the peripheral surface of the bore enable the expansion shell to anchor itself thereto. Moreover, in case of vibrations in the rocky bed on which this bolt is mounted, for example in view of an adjacent blast or following a ground blow (a natural phenomenon which consists of a sudden and unexpected expansion of rock), during which major shearing forces appear at the interface between the blades 418 and the rocky surface circumscribing the drilling bore, this bolt may immediately lose its load, for example by breaking and by rendering friable the rock portions grasped by the teeth 419. This sensitivity to vibrations is still greater when such a bolt is used on an excavation wall made up of soft or broken rock, in which case even weak vibrations are sufficient for the blades teeth to render friable and to disintegrate the peripheral surface of the bore, which will generate load loss of the bolt. For this reason, these bolts cannot usually be used on excavation walls made from soft or broken rocks.

The anchoring bolt with elastic expansion sheath of the present invention is adapted to solve these problems, while remaining cheap and of easy installation. Indeed, when its stud bolt is pivoted so that the anchoring head tilts in operative position, the expansion sheath is pressed against the rock surface circumscribing the drilling bore, and since the expansion sheath is made from an elastically deformable material, all the periphery of the exterior surface of the expansion sheath abuts against the internal surface of the bore, thus deforming to perfectly match the corresponding uneven surfaces.

Hence, anchoring of the anchoring head on the internal surface of the bore is performed by tightly applying of all the periphery of the expansion sheath against this bore surface, and permits adaptation to apparent uneven surface features, thus maximising contact area, and thus frictional force, between the anchoring head and the internal surface of the bore. This feature is advantageous relative to conventional mechanical anchoring bolts, for which anchoring in the bore is limited to discrete biting of a limited number of teeth in the bore surface. Moreover, the expansion shell of the conventional mechanical anchoring bolts is not able to adapt to uneven surface features found at the surface of the bore, and it is liable moreover to render friable the rock if shearing forces appear at the interface between the latter and the rock. With the elastic expansion sheath bolt of the present invention, weak vibrations may generate deformation of the elastic sheath rather than the rendering friable of the bore surface. This will allow the rock, even if it is soft or broken, to maintain its integrity in case of vibrations in the rocky bed. The deformation capability of the elastic sheath thus allows the anchoring bolt to keep its load even if shearing forces appear at the interface between the expansion sheath and the internal surface of the bore.

Alternate embodiments of the present invention are also envisioned, such as the one shown in FIGS. 4-6*c*. In this embodiment, structures similar to those of the embodiment of FIGS. 1-3*b* are found, and their reference numerals correspond to those of the embodiment of FIGS. 1-3*b* but upgraded to 100 series (for example, the anchoring bolt, bearing numeral 10 on FIGS. 1-3*b*, bears numeral 110 in the embodiment of FIGS. 4-6*c*).

FIGS. 4-6*c* show an anchoring bolt 110, similar to bolt 10 of FIGS. 1-3*b*, but being different therefrom by some features. First of all, stud bolt 112, instead of being threaded on all its length, is threaded only at its two end portions. A threaded portion located close by to the proximal end 112*b* enables screwing on stud bolt 112 of the two nuts 130, 131, and the other threaded portion located close by to the distal end 112*a* enables the screwing of the movable insertion wedge 116. Moreover, the stationary assembly formed by two nuts 24, 24, screwed against one another on the embodiment of FIGS. 1-3*b* is replaced by a steel tube 124, pressed against and integral to the central unthreaded portion of stud bolt 112. The tube 124 may rotate integral with the stud bolt 112 when the latter is pivoted around its longitudinal axis. Moreover, the expansion sheath 118 is provided with four elongated bands 119 made from a soft elastic material, regularly spread apart on the periphery of the external surface of the expansion sheath 118. These bands 119 may be for example shorter than the expansions sheath 118, and be mounted on the end portion of the expansion sheath 118 facing the stationary insertion wedge 120; alternatively, these bands may have the same length as the expansion sheath. Finally, the movable insertion wedge 116 comprises only one main cylindrical portion 116*a* and a frusto-conical portion 116*c*, contrarily to the movable insertion wedge 16 of FIGS. 1-3*b* which further comprises a rear stopper 16*b*.

Figure 6A:
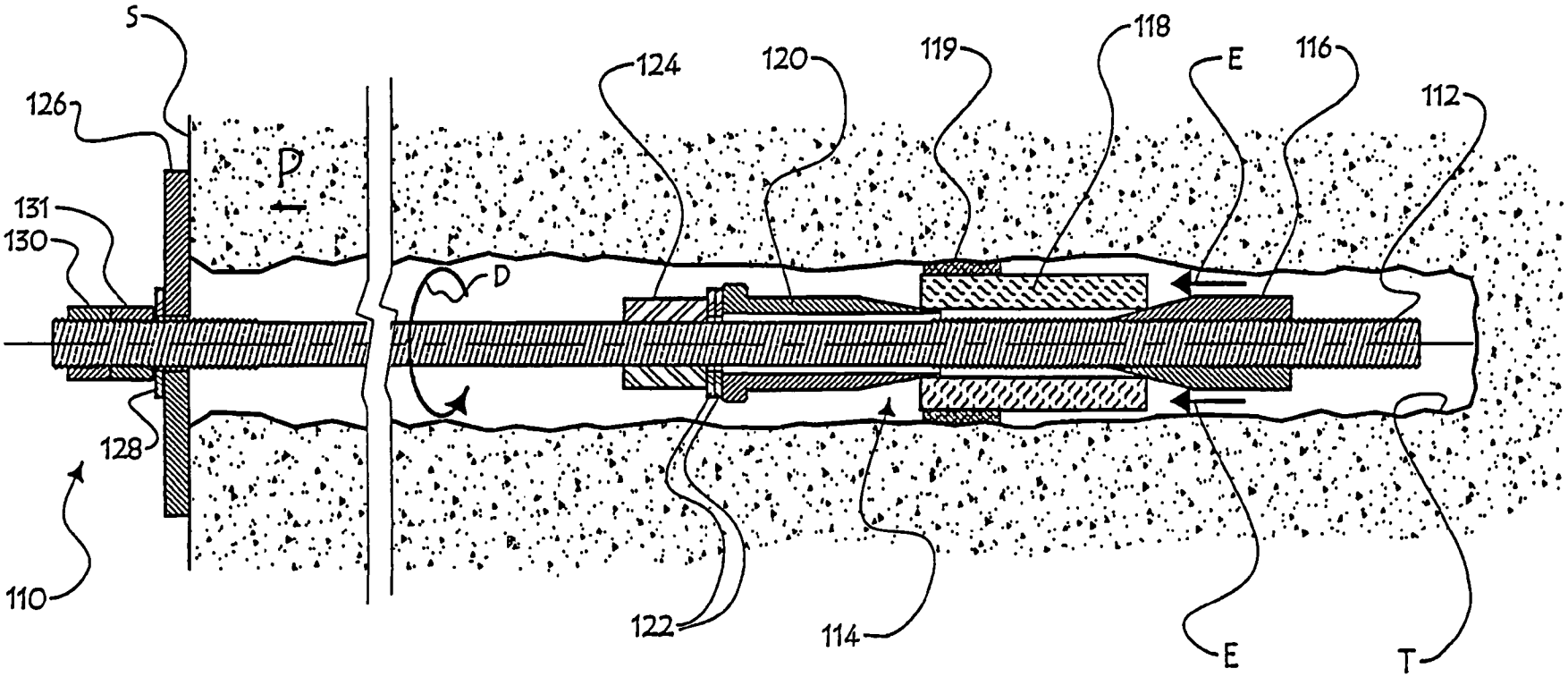
FIGS. 6*a* and 6*b* are views similar to those of FIGS. 3*a* and 3*b*, but showing the anchoring bolt from the embodiment of FIG. 4.
Figure 6B:
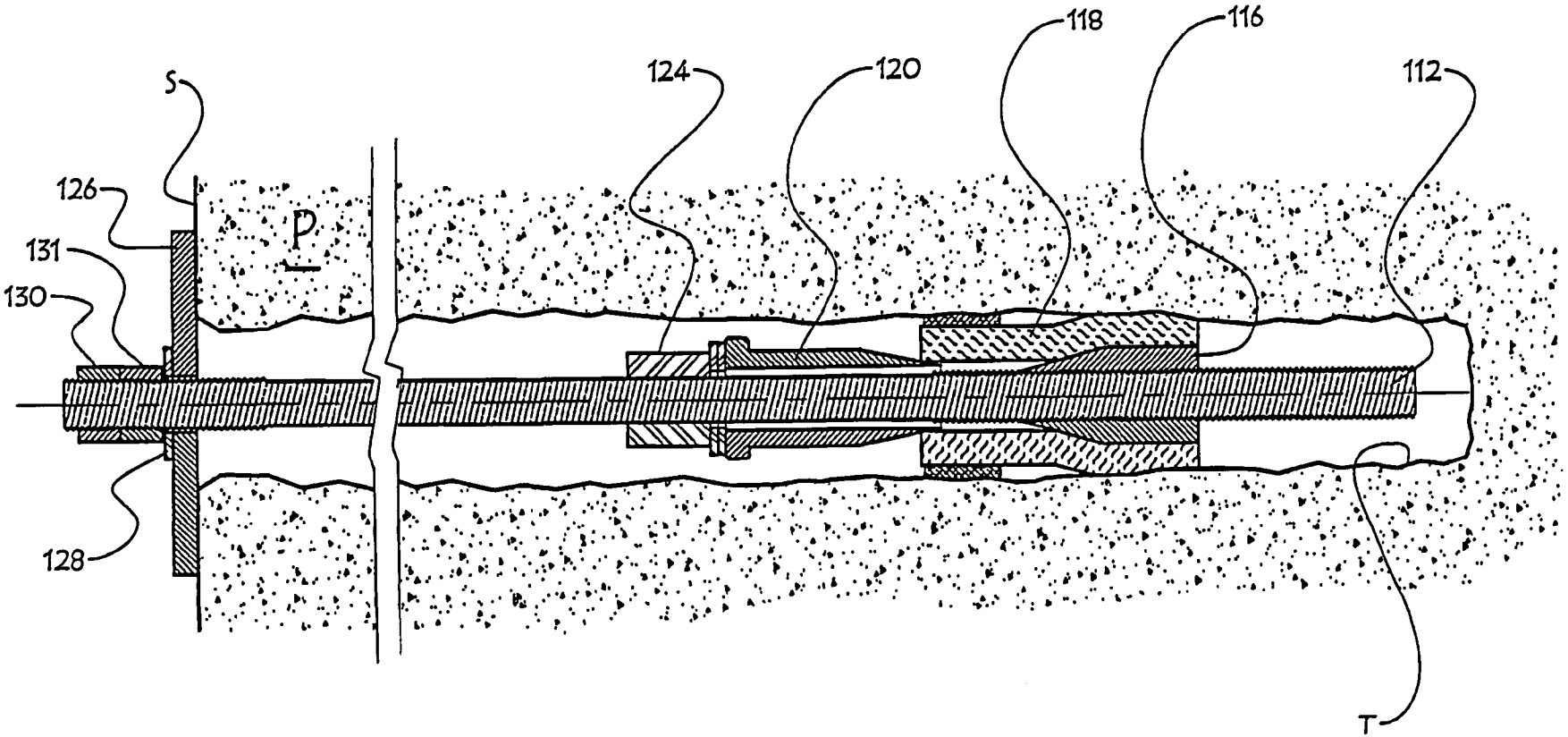

The method for mounting the anchoring bolt 110 is similar to that of anchoring bolt 10. First of all, the anchoring head 114 is adjusted by manually screwing the insertion wedge 116 to slightly wedge the expansion sheath 118 between the two insertion wedges 116 and 120. After that, stud bolt 112 on which is mounted the anchoring head 114 is engaged into bore T previously drilled into an excavation wall P, the bands 119 slightly engaging the internal surface of bore T, as illustrated on FIG. 6*a*. Thereafter, the stud bolt 112 is pivoted around its longitudinal axis as suggested by arrow D on FIG. 6*a*. Bands 119 engage the internal surface of the bore, and allow retention of the expansion sheath 118 so that the latter remain stationary notwithstanding rotational motion of the stud bolt 112. The frictional abutment of the movable insertion wedge 116 against the expansion sheath 118 also allows the movable insertion wedge 116 to remain stationary even though there is rotational movement of stud bolt 112. Hence, by pivoting the stud bolt 112, the stud bolt 112 pivots relative to the insertion wedge 116, which enables the insertion wedge 116 to screwingly move toward the expansion sheath 118, as suggested by arrows E on FIG. 6*a,* and to progressively engage into its cavity 118*c,* so as to radially stretch the expansion sheath 118 to compress same against the internal surface of the bore T, as shown in FIG. 6*b.*

The anchoring bolt 110 is able to perform adequately even in case of deformation of the rocky bed onto which it is installed. An example of deformation is the expansion (or release) of the rocky bed, consisting of a relative displacement of the rocky blocks that make it up, which generate volumic expansion of the rocky bed. Hence, the excavation walls, in case of release of the rocky bed, will tend to take expansion and to close toward one another, as suggested by arrows H on FIG. 6*c,* and the bore T in which the bolt is mounted will thus have a tendency to extend. Rocky bed expansion is liable to occur during adjacent blasts.

Figure 6C:
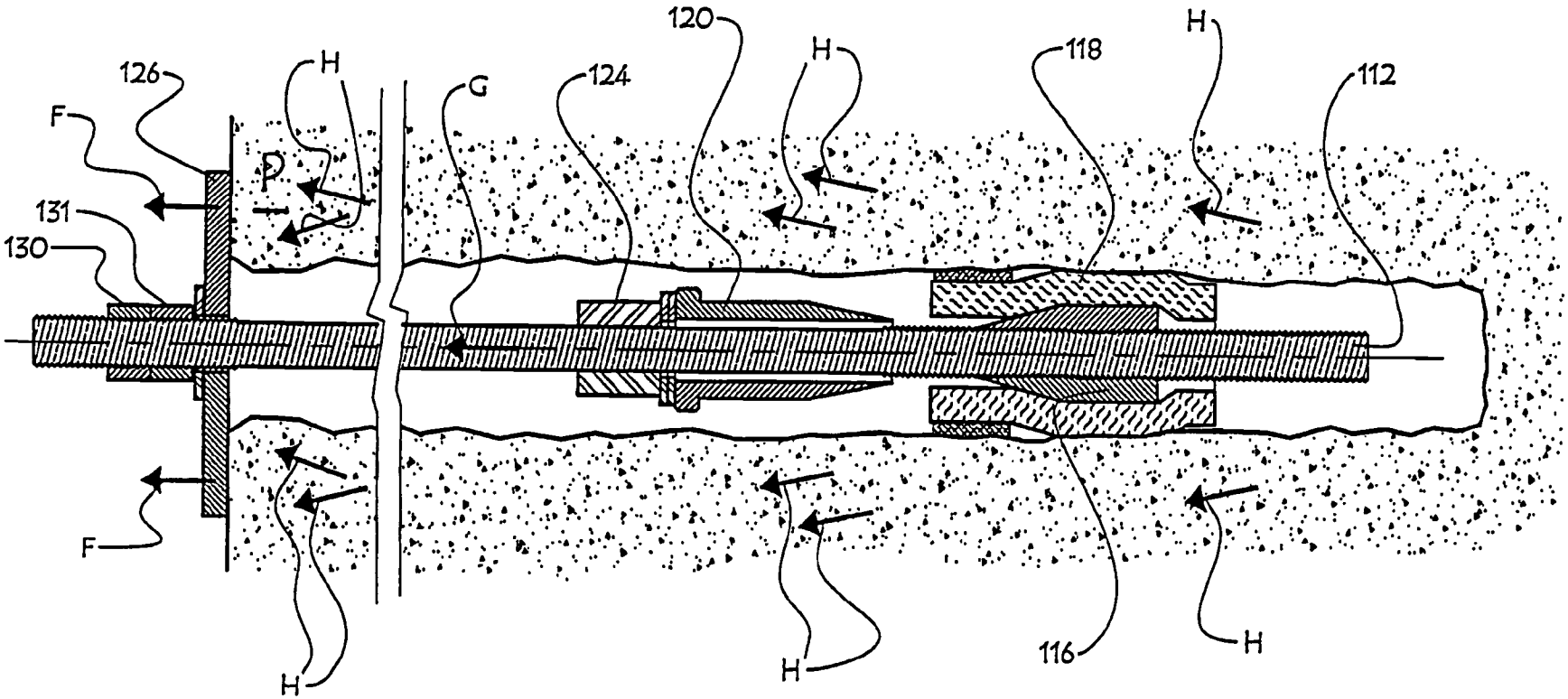
FIG. 6*c* shows a view similar to that of FIGS. 6*a* and 6*b*, but dynamically showing the anchoring bolt during rocky bed expansion.

FIG. 6*c* shows the behaviour of the anchoring bolt 110 following a rocky bed expansion. When the rocky bed expands, and thus when the bore T extends, the bearing plate 126 is brought about by the surface S of the wall P which expands and will close, as suggested by the arrows F of FIG. 6*c.* The bearing plate 126 brings with it the stud bolt 112, which will be axially pulled outwardly from bore T, as suggested by arrow G, and consequently also brings the insertion wedge 116 screwed on the stud bolt 112. This movement toward the exterior of bore T of insertion wedge 116 will not bring about the displacement of the expansion sheath 118, since the latter remains applied against and firmly grasped onto the internal surface of the bore T. This way, when the rocky bed releases itself and when the excavation wall expands, and when a very strong tension force is transmitted by the bearing plate 126 to the stud bolt 112, the insertion wedge may forcibly engage and slide in the cavity 118*c* of the expansion sheath, rather than producing load loss of the bolt. That is to say, the fact that the insertion wedge 116, contrarily to the insertion wedge 16 of the embodiment of FIGS. 1-3*b,* is not provided with a rear stopper, will enable it to slide interiorly or and along the cavity 118*c* of the expansion sheath, as shown on FIG. 6*c,* the insertion wedge 116 radially stretching and continuously compressing the expansion sheath 118 against the bore surface when it is in its cavity. The fact that the insertion edge 116, lacking an aft stopper, may slide along the cavity 118*c* of the expansion sheath enables the anchoring bolt 110 to accommodate a lengthening of the bore T, and thus to retain its load despite expansion of the rocky bed.

This is a major improvement compared to current mechanical anchoring bolts. Since the conventional mechanical anchoring bolts do not have any means to accommodate a bed expansion, the expansion of the bed generally causes either the crumbling of the rocky surface circumscribing the bore at the level of its contacting points with the toothed blades, or, if the anchoring head does non "ungrip" from the rocky surface surrounding the bore, the generation of excessive biasing forces on the bearing plate will lead to its rupture.

Figure 7:
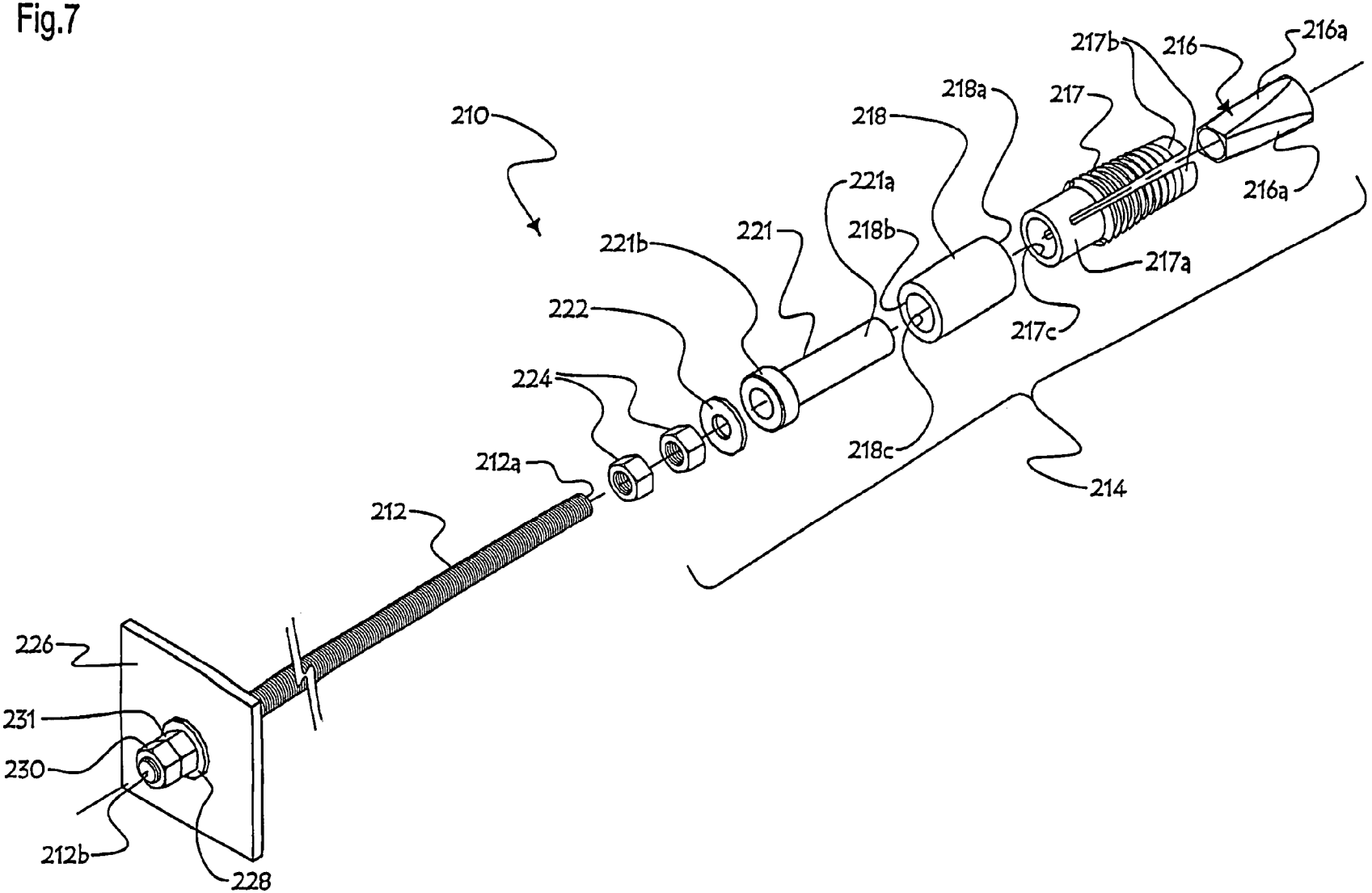
FIG. 7 shows an exploded perspective view of an anchoring bolt according to a third embodiment of the invention.
Figure 8:
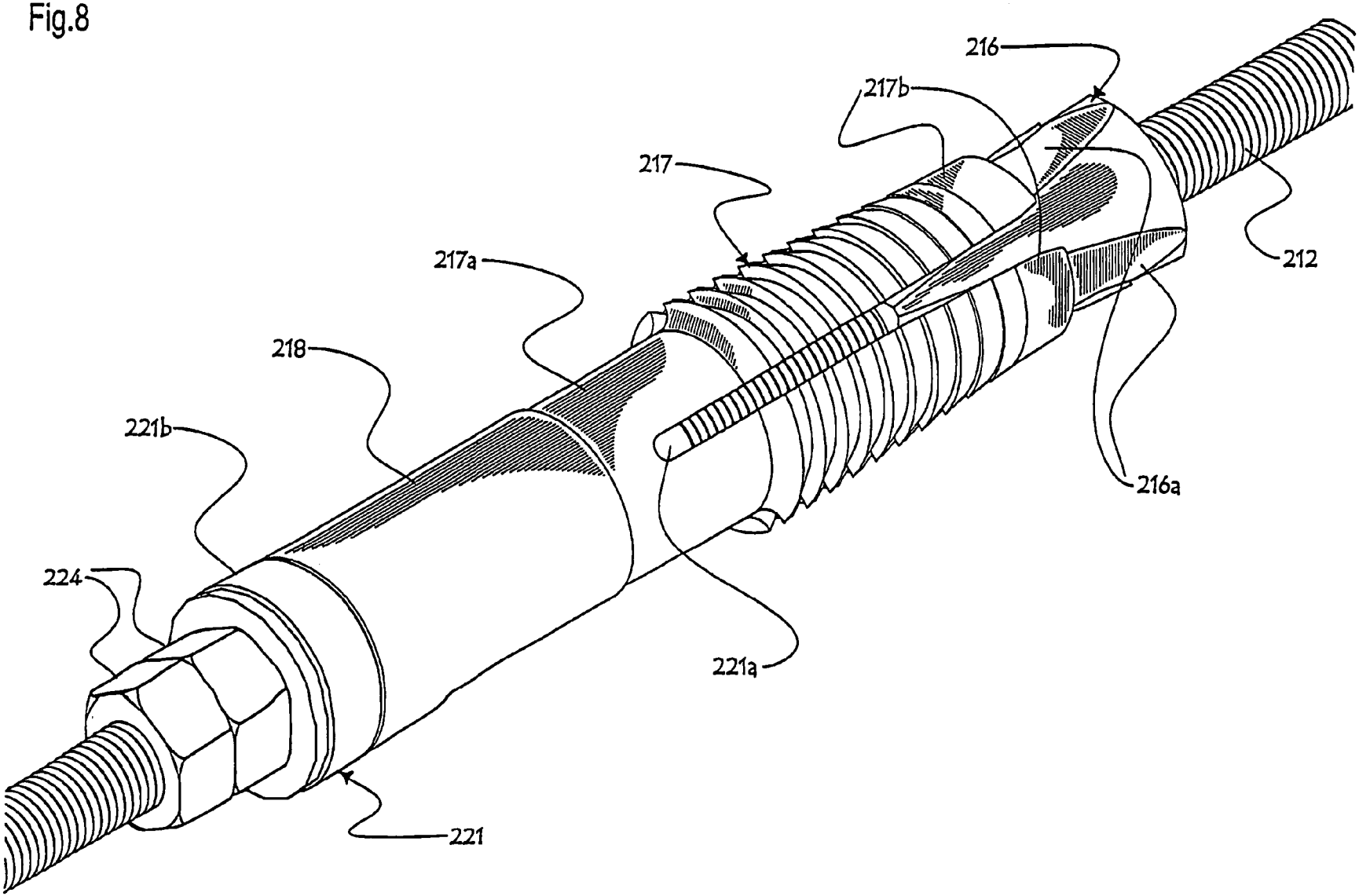
FIG. 8 is an enlarged perspective view showing in particular the anchoring head from the anchoring bolt of FIG. 7.
Figure 9:
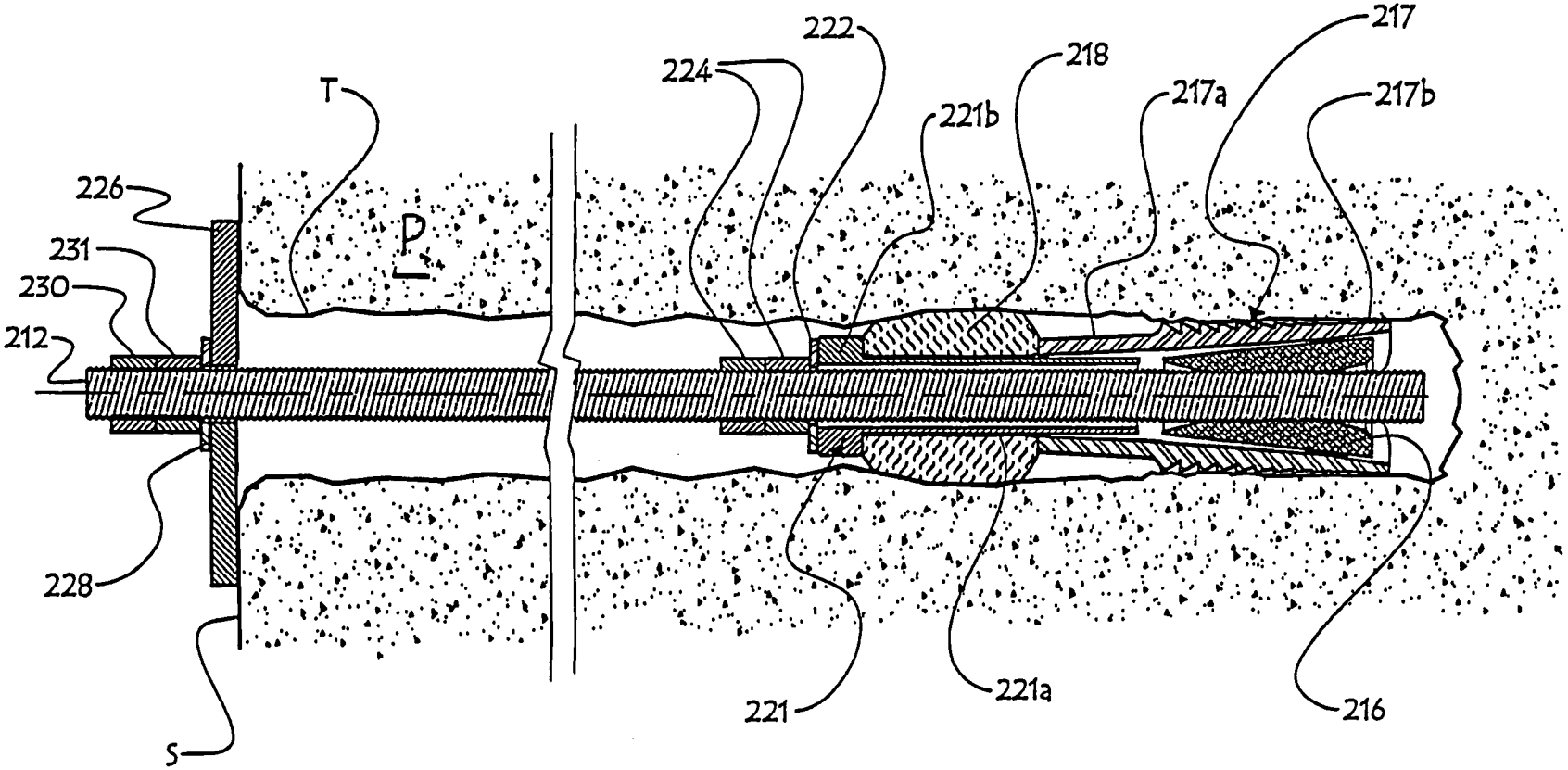
FIG. 9 is a broken vertical sectional view of a rocky bed, showing in sectional view the anchoring bolt of FIG. 7 mounted inside a bore drilled in this rocky bed, and showing its anchoring head in operational position mounted in this bore.

Another embodiment of the invention is shown on FIGS. 7-9. In these figures, the structures similar to those of the embodiment of FIGS. 1-3*b* have the same reference numerals but upgraded to 200 series. For example, the anchoring bolt, referenced 10 in the embodiment of FIGS. 1-3*b,* is referenced 210 in the embodiment of FIGS. 7-9.

In this embodiment, the stud bolt 212 is threaded on all its length, and is provided close by at its distal end 212*a* with an anchoring head 214. This anchoring head 214 comprises an assembly of two nuts 224 screwed and tightened against one another, integral in rotation with the stud bolt 212. Moreover, a hollow sleeve 221, whose interior cavity 221*c* is smooth and unthreaded, is mounted on the stud bolt 112, and its read surface abuts against an O-ring 222, in turn abutting against the two nuts 224 screwed against one another. The sleeve 221 integrally defines a main cylindrical part 221*a,* as well as a rear stopper 221*b* being diametraly larger and of annular shape, located at one of the ends of the main cylindrical portion 221*a.* An expansion sheath 218, whose interior cavity 218*c* has a diameter corresponding to the exterior diameter of the main cylindrical part 221*a* of sheath 221, is fitted around the main cylindrical part 221*a* of the sleeve 221; the expansion sheath 218 is shorter than the main cylindrical part 221*a* of the sleeve. Moreover, the anchoring head 214 comprises an expansion shell 217. This expansion shell 217 defines a portion of hollow annular base 217*a* to which are integral connected four blades 217*b* having an exterior toothed surface. The hollow annular part 217*a* has a diameter corresponding to that of the exterior surface of the cylindrical part 221*a* of the sleeve, and the hollow annular part 217*a* axially slidingly engages and fits over the cylindrical part 221*a* of the sleeve. Moreover an insertion wedge 216 of frusto-conical shape, screwed to the stud bolt 212, may engage between the four blades 217*b.* FIG. 7 shows that the insertion wedge 216 defines four flattened portions 216*a,* in front of each of which registers a corresponding one of the blades 217*b.*

The method of installation of the anchoring bolt 210 will now be detailed. First, the anchoring head 214 must be adjusted so that the insertion wedge 216 engage between the four blades 217*b* of the expansion shell, without however the insertion wedge 216 applying pressure on the blades 217*b* nor spreading apart the latter. Such a configuration of the anchoring head 215 is shown in FIG. 8. Thereafter, the stud bolt 212 provided with the anchoring head 214 is sunk into the bore made in the excavation wall. The stud bolt 212 is then pivoted in a given direction, and since the blades 217*b* of the expansion shell frictionally rest against the internal surface of the bore and the blades 217*b* engage the flattened part 216*a* of the insertion wedge 216, thus preventing the latter from being brought into rotation together with the stud bolt 212, a relative movement of the stud bolt 212 relative to the insertion wedge is generated, wherein screwing motion of the insertion wedge 216 toward the expansion shell is generated. The axial displacement of the insertion wedge 216 toward the expansion shell 217 will generate radial spreading apart of the blades 217*b,* whose exterior surface thus comes to press and to grip the surface of bore T. Concurrently, the displacement of insertion wedge 216 toward the expansion shell 217 pushes the latter toward the expansion sheath 218, and the hollow annular part 217*a* of the expansion shell slides along the cylindrical part 221*a* of the sleeve and then axially compresses the expansion sheath 218. The progressive axial compression of the expansion sheath 218 by the expansion shell 217 induces radial expansion of the expansion sheath 218, which progressively takes an arcuate shape. The expansion sheath 218 thus diametraly widens, it compresses against the internal surface of the bore drilled into the wall P of the excavation, as suggested in FIG. 9.

The thus compressed expansion sheath 218 has two purposes. First, the fact that it remains firmly abutted against the rocky surface circumscribing the bore, in combination with the biting action of the toothed blades spread apart on this internal surface of the bore, allows generation of a frictional force between the anchoring head 214 and the surface of the bore qui enables the anchoring head 214 to be firmly anchored in the rocky bed. Moreover, the expansion sheath being made from an elastic material, and thus having a tendency to return to its original shape when deformed, the expansion sheath has the role of a spring on the expansion shell 217. Indeed, when axially compressed, the expansion sheath pushes on the annular hollow part 217*a* of the expansion shell, and if vibrations or strong shearing forces generate a crumbling of the rock by the toothed blades at the interface between the toothed blades 217*b* and the surface of the bore (as disclosed herein-above, the rock crumbling of the internal surface of the bore is a common problem with expansion shell bolts), the elastic expansion sheath 218 may slightly expand and further push the expansion shell 217 toward the expansion wedge 216, wherein the latter remains stationary, which enables the blades 217*b* to augment their spreading apart toward the internal peripheral surface of the bore, and at their exterior toothed surface to regain their grip on this internal surface of bore.

Figure 10:
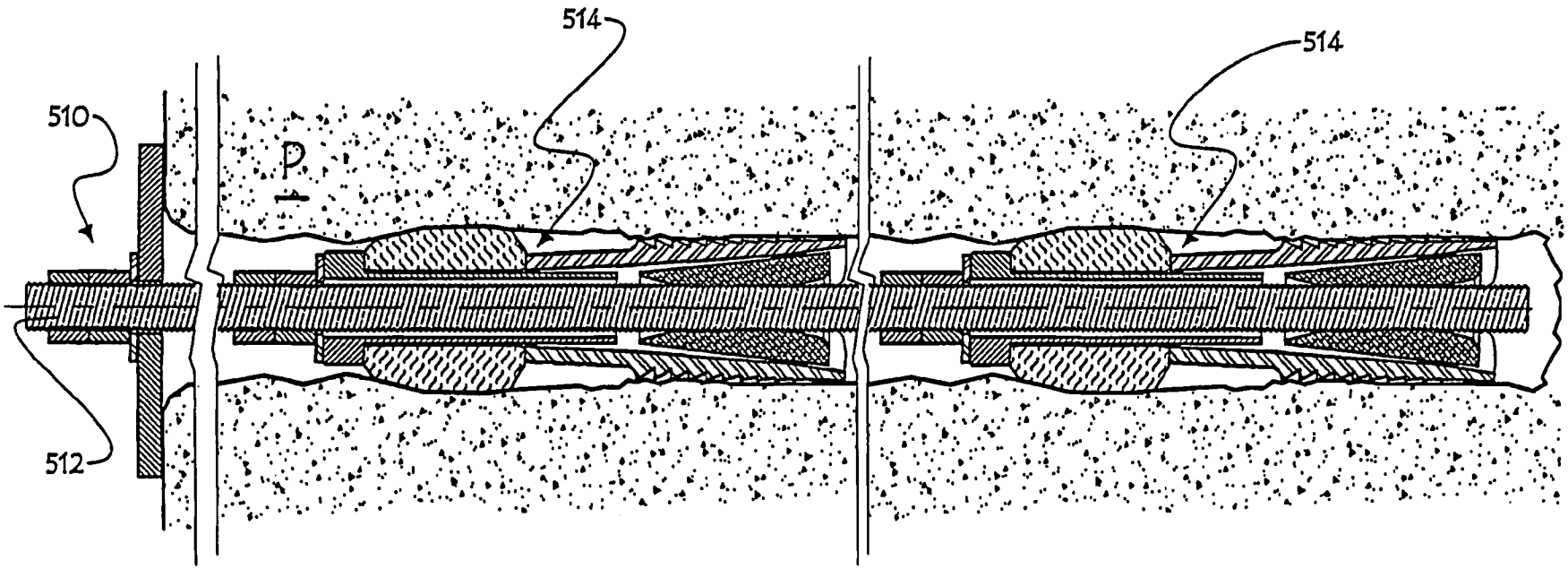
FIG. 10 is a view similar to that of FIG. 4, but showing a multiple-anchoring heads anchoring bolt according to a fourth embodiment of the present invention, and showing the multiple anchoring heads of this bolt in operational position.

Another embodiment of the invention, illustrated in FIG. 10, could be envisioned. This embodiment of anchoring bolt 510 comprises a stud bolt 512 on which are mounted several anchoring heads 514. The anchoring bolt 510 of this embodiment has the advantage of having a plurality of anchoring points in the rock along the bore, and may thus resist to greater loads.

Another embodiment of the invention, illustrated in FIGS. 11 and 12, may also be envisioned. The anchoring device 310 of this embodiment makes use of an anchoring bolt commonly known as "Split Set", consisting of a steel tube 311 defining a proximal end 311*a* and a distal end 311*b*, as well as a slit 311 e extending all along its length. The proximal end 311*a* of the tube 311 is flared and defines therein a lip 311*c*, destined to retain a ring 311*d*. The ring 311*d* is in turn adapted to retain a bearing plate 326, bored at its centre and engaged by the tube 311. It is also noted from FIG. 11 that the distal end portion of tube 311 is slightly thinner, and in that its diameter is smaller relative to the central part of the tube.

A tube of "Split Set" type, such as the tube 311 shown in FIG. 11, may be used alone for the support of a wall. Its installation first consists of the drilling of a bore having a diameter smaller than the central part of the tube. Thereafter, the shorter distal end portion of tube 311 is engaged in the bore, and the tube 311 is hammered, by its proximal end 311*a*, so that the tube be progressively engaged in the drilled bore. The is tube 311 may be sunk into the bore by using the percussion function of the percussion/rotation drilling machine used to drill the bore. Since the central part of the tube 311 has a larger diameter than the hole, its engagement in the bore generates a tightening of the tube, the slit 311*e* progressively closing itself, so that the tube diameter may adapt itself to that of the bore to be able to engage therein. The tube 311 is brought inside the bore until the bearing plate 326 comes to tightly abut against the exterior surface of the excavation wall.

The elastic capability of tube 311, which has deformed to a diametraly smaller size so as to be able to engage into the bore, enables same to act as a spring and to continuously bias same toward its original undeformed shape. This permits the exterior surface of the tube 311 to apply a radially outward pressure on the internal surface of the bore, generating in this way a frictional force between the external surface of the tube and the internal surface of the bore, thus providing a firm anchoring of the tube in the bore.

This tube 311, when mounted on an excavation wall, has the advantage of being able to accommodate expansion of the rocky bed. Indeed, if the rock bed expands, where the excavation wall has a tendency to close itself and the drilled bore has a tendency to lengthen, the tube may be brought by the bearing plate 326, itself brought about by the closing wall, and the tube may slide relative to the bore. However, this bolt cannot resist to very strong loads.

The present invention envisions the use of an anchoring bolt of the "Split Set" type in combination with one of the embodiments of anchoring bolt with elastic expansion sheath as disclosed herein-above, to increase the resistance of the bolt. By engaging an anchoring bolt 310 in the tube 311 (the anchoring bolt 310 is similar to the anchoring bolt 10 of FIGS. 1-3*b*, however lacking a bearing plate), after the tube 311 has been engaged in the bore drilled in the excavation wall, and by pivoting the stud bolt 312 in such a manner as to tilt the anchoring head 314 in operative position, the elastic expansion sheath 318 radially compresses against the internal surface of the tube 311, and further presses the steel tube 311 against the internal surface of the bore. The outcome of this is to complete the spring effect of the split tube and thus to augment the frictional force between the external surface of the tube 311 and the internal surface of the rock circumscribing the drilled bore, and thus to enable the tube 311/anchoring bolt 310 assembly to resist to stronger loads compared to the steel tube 311 of the "Split Set" type used alone.

Another embodiment (not shown) of the anchoring bolt of the present invention could comprise a stud bolt, to the proximal end of which is fixedly secured a bearing plate, and comprising an anchoring head having an expansion sheath mounted on a sleeve (similar to sleeve 221 of FIG. 7), the sleeve defining a main cylindrical portion and a rear stopper. Moreover, the anchoring head comprises a push member defining a first hollow threaded portion screwed on the stud bolt, and a second hollow portion having an unthreaded interior cavity and slidingly engaging the cylindrical part of the sleeve, in such a way that the expansion sheath be located between this second part and the rear stopper of the sleeve. This push member may be drawn in motion by screwing along the stud bolt by rotating same, to enable the push member to come to axially compress the expansion sheath against the rear stopper of the sleeve. By axially compressing the expansion sheath, it will sustain a radial expansion and will take an arcuate shape (as in FIG. 9), and will come to tightly apply against the surface circumscribing the bore, to enable anchoring of the anchoring head in the rock.

In another embodiment of the invention (not shown), the stud bolt of the herein-above disclosed embodiments may be replaced by any suitable support member. For example, rather than being mounted on an elongated stud bolt extending on all the length of the drilled bore, the elastic expansion sheath anchoring head may comprise a bolt on which are mounted the expansion sheath as well as the actuation member(s) (insertion wedge(s), sleeve, etc.), and relative to which the actuation member(s) may move to apply pressure on the expansion sheath and tilt the anchoring head in operative position. The support member, in this case, may be a firm metallic cable being used to interconnect the anchoring head to an abutment member which may abut against the exterior surface of the excavation wall, such as a bearing plate. The cable may be firmly tightened between the anchoring head anchored in the rocky bed and the bearing plate, to ensure the support of the excavation wall.

A person skilled in the art could envision still other embodiments of anchoring bolts which may be different from those disclosed herein-above. However, for reasons of clarity of reading, all of these embodiments have not been described, but it is understood that they should all be considered to be within the scope of the following claims.

The invention claimed is:

1. Anchoring device for stabilising an excavation wall, and to be at least partially engaged into a bore drilled into the excavation wall, said anchoring device comprising:

an elongated rigid rod, defining a distal end for engagement into the drilled bore, a proximal end opposite said distal end and a longitudinal axis extending in between said distal and said proximal end thereof;

a bearing member mounted on said rigid rod proximate to said proximal end thereof, for bearing against an exterior surface of the rocky bed; and an anchoring head mounted on said rigid rod and for engagement into the drilled bore of the excavation wall, said anchoring head comprising:

a flexible expansion sheath, made from an elastic material and adapted to stretch and radially widen and defining a first end, a second end and an interior cavity engaged by said rigid rod, wherein said cavity defines a first mouth proximate to said first end of said expansion sheath; and an actuation member defining a longitudinal interior cavity and movably mounted on said rigid rod, said actuation member mounted for relative movement to said rigid rod and to said expansion sheath and engageable with the latter, said actuation member adapted to exert a pressure on said expansion sheath; said actuation member comprising an insertion member movable axially along said rod when the latter is pivoted around its longitudinal axis, said insertion member at least partially engageable into said interior cavity of said expansion sheath by said first mouth, to apply outward pressure on a peripheral surface of said interior cavity of said expansion sheath at least proximate to said first end thereof, to generate stretching and radial expansion of said expansion sheath at least proximate to said first end thereof:

wherein for anchoring said anchoring head into the excavation wall at the level of the bore drilled therein, said actuation member and said expansion sheath must be moved relative to one another so as to enter into contact with one another, and in such a way as to enable said actuation member to exert a pressure on said expansion sheath to generate radial expansion of at least one portion of the latter, so that said portion of said expansion sheath comes to frictionally abut against a part of the internal surface circumscribing the drilled bore in the excavation wall.

2. An anchoring device as in claim 1, wherein said expansion sheath is of cylindroid shape.

3. An anchoring device as in claim 2, wherein said elongated rigid rod is at least partly threaded, and wherein said actuation member defines a longitudinal interior cavity having a peripheral wall being also at least partly threaded and threadedly engages said rod, and in that said rod is pivotable around said longitudinal axis to generate a displacement of said actuation member threadedly axially along said rod, to enable relative displacement of said actuation member relative to said expansion sheath.

4. An anchoring device as in claim 1, wherein said insertion member is an insertion wedge comprising a frusto-conical portion, said insertion wedge at least partially engageable into said internal cavity of said expansion sheath by said first mouth thereof to generate expansion and radial stretching of said expansion sheath at least proximate to said first end thereof.

5. An anchoring device as in claim 4, further including a retention member mounted stationarily onto said rod, said second end of said expansion sheath being abuttable against said retention member when said insertion wedge engages into said first mouth of the interior cavity to radially outwardly stretch said expansion sheath.

6. An anchoring device as in claim 5, wherein said cavity of said expansion sheath defines a second mouth opposite said first mouth and located proximate to said second end of said expansions mouth, wherein also said retention member comprises a second insertion wedge defining a second frusto-conical portion, said second insertion wedge engageable into said second mouth of said cavity of said expansion mouth when said insertion wedge moves toward said expansion sheath and pushes the latter towards said second insertion wedge.

7. An anchoring device as in claim 1, further including a retention member mounted stationarily on said rod, and wherein said actuation member is a push member movable along said rod and which can push said expansion sheath against said retention member so as to axially compress said expansion sheath and to generate radial expansion thereof.

8. An anchoring device as in claim 7, further including a hollow sleeve engaged by said rod and maintained in axially stationary fashion thereon, and defining a main cylindrical portion and a rear annular stopper projecting radially outwardly from one of the ends of said main cylindrical portion, said rear stopper forming said retention member, said main cylindrical portion of said sleeve engaging said interior cavity of said expansion sheath.

9. An anchoring device as in claim 8, wherein said push member comprises an expansion shell having a first end portion being annular and hollow and slidingly engaging said main cylindrical portion of said sleeve, so that said expansion sheath can become wedged between said annular end portion of said expansion sheath and said rear stopper of said sleeve, said expansion shell further comprising a number of blades having a toothed exterior surface, said push member further comprising an insertion wedge movably threadingly mounted to said threaded rod and movable toward said expansion shell, both to engage between said blades of said expansion shell and to generate their spreading apart to enable their being applied against the peripheral surface circumscribing the drilled bore in the excavation wall, and to slidingly push said first end portion of said expansion shell along said main cylindrical portion of said sleeve and against said expansion sheath and to generate axial compression of the latter, and consequently the radial expansion thereof to enable its being applied against the peripheral surface circumscribing the drilled bore in the excavation wall.

10. An anchoring device as in claim 1, wherein said bearing member is a bearing plate.

11. An anchoring device as in claim 1, wherein said rod is provided with at least two anchoring heads to increase the number of anchoring points along the drilled bore in the excavation wall, so that said anchoring device may resist to stronger loads.

12. An anchoring device as in claim 1, wherein said expansion sheath comprises at least one elongated band fixedly secured to an exterior surface of said expansion sheath.

13. An anchoring device for stabilizing an excavation wall from a rocky bed, and to be at least partially engaged into a bore drilled into the excavation wall, said anchoring device comprising:

an adjustable diameter tube, for engagement into the drilled bore in the excavation wall, and having an exterior surface for applying a radially outward pressure on the internal surface of the bore;

a bearing member mounted on said tube proximate to a proximal end thereof, for bearing against an exterior surface of the excavation wall;

an elongated rigid rod which is at least partly threaded, defining a distal end engaged into said tube, and a proximal end opposite said distal end thereof, said rod defining a longitudinal axis extending between said distal and proximal ends thereof; and an anchoring head mounted on said rod and engaged into said tube, said anchoring head comprising:

a flexible expansion sheath, of cylindroid shape, made from an elastic material and adapted to stretch and radially widen and defining a first end, a second end and an interior cavity engaged by said rigid rod, wherein said cavity defines a first mouth proximate to said first end of said expansion sheath; and an actuation member defining a longitudinal interior cavity having a peripheral wall being also at least partly threaded and threadedly engaging said rigid rod, said rod being pivotable around said longitudinal axis to generate a displacement of said actuation member threadedly axially along said rod, to enable relative displacement of said actuation member relative to said expansion sheath, said actuation member comprising an insertion member movable axially along said rod when the rod is pivoted around its longitudinal axis, said insertion member at least partially engageable into said interior cavity of said expansion sheath by said first mouth, to apply radially outward pressure on a peripheral surface of said interior cavity of said expansion sheath at least proximate to said first end thereof, to generate stretching and radial expansion of said expansion sheath at least proximate to said first end thereof;

wherein to bring into operational condition said anchoring device, said rod and said anchoring head must be engaged into said tube, said tube having previously been engaged into the drilled bore of the excavation wall, and then said actuation member and said expansion sheath must be moved relative to one another for engagement with one another, so as to enable said actuation member to apply a pressure on said expansion member to generate radial expansion of at least a portion of the latter, so that said portion of said expansion member come to apply a radial pressure against an internal surface of the tube to enable increase of the pressure applied by said external surface of said tube against the internal surface of the bore.

14. An anchoring device as in claim 13, wherein said insertion member is an insertion wedge comprising a frusto-conical position.

15. An anchoring device as in claim 14, further comprises a retention member mounted stationarily onto said rod, said second end of said expansion sheath being abuttable against said stationary retention member when said insertion wedge engages into said first mouth of the interior cavity to radially outwardly stretch said expansion sheath.

* * * * *